US010118725B2

(12) United States Patent
Al-Housseiny

(10) Patent No.: US 10,118,725 B2
(45) Date of Patent: Nov. 6, 2018

(54) RAPIDLY ERECTED AND COLLAPSIBLE CONTAINER AND METHOD OF USING SAME

(71) Applicant: Talal T. Al-Housseiny, Princeton, NJ (US)

(72) Inventor: Talal T. Al-Housseiny, Princeton, NJ (US)

( * ) Notice: Subject to any disclaimer, the term of this patent is extended or adjusted under 35 U.S.C. 154(b) by 81 days.

(21) Appl. No.: 15/358,840

(22) Filed: Nov. 22, 2016

(65) Prior Publication Data

US 2018/0141699 A1 May 24, 2018

(51) Int. Cl.

| | |
|---|---|
| ***B65D 5/36*** | (2006.01) |
| ***B65D 5/42*** | (2006.01) |
| ***B65D 5/02*** | (2006.01) |
| ***B31B 1/76*** | (2006.01) |

(52) U.S. Cl.

CPC ..... *B65D 5/3621* (2013.01); *B31B 1/76* (2013.01); *B65D 5/02* (2013.01); *B65D 5/4266* (2013.01); *B31B 2201/28* (2013.01); *B31B 2203/006* (2013.01)

(58) Field of Classification Search

CPC ..... B65D 5/3621; B65D 5/02; B65D 5/4266; B65D 2571/00487; B65D 71/0022; B65D 2571/00524; B65D 2571/00839; B31B 1/76

USPC ..... 229/117.05, 117.01, 120.09, 120.18, 229/120.21, 120.14, 120.15, 165; 206/180, 190, 175, 184, 186; 493/51, 59

See application file for complete search history.

(56) References Cited

U.S. PATENT DOCUMENTS

| | | | |
|---|---|---|---|
| 728,749 | A | 5/1903 | McCord |
| 1,158,130 | A | 10/1915 | Hawkins |
| 2,795,352 | A | 6/1957 | Ringler |
| 3,119,547 | A | 1/1964 | Nute |
| 3,199,762 | A | 8/1965 | Coons |

(Continued)

FOREIGN PATENT DOCUMENTS

| | | | |
|---|---|---|---|
| GB | 1315598 | A | 5/1973 |

OTHER PUBLICATIONS

International Search Report and Written Opinion; International Application No. PCT/US2017/060565; International Filing Date Nov. 8, 2017; 6 pages.

*Primary Examiner* — Christopher Demeree

(74) *Attorney, Agent, or Firm* — Blank Rome LLP; Matthew J. Esserman

(57) ABSTRACT

A rapidly erected and collapsible container and method of using same are disclosed. The container is movable between a flat and a box configuration. The container includes two primary panels, two secondary panels, and a main link part. The two primary panels, which are movably coupled to the main link part, are configured to move away and sideways from each other, whereby the two primary panels face each other across a gap when the container is in the box configuration. The main link part provides, at least partly, a base panel for the container and may enable maintaining the container in the box configuration. Embodiments foster a container that rapidly, easily, and conveniently transitions from a flat configuration to being ready for use in a box configuration. Moreover, the container may be produced using significantly less material than conventional containers without compromising effectiveness and structural integrity.

51 Claims, 22 Drawing Sheets

(56) References Cited

U.S. PATENT DOCUMENTS

| | | | | |
|---|---|---|---|---|
| 3,549,081 | A | 12/1970 | Nelson | |
| 3,642,192 | A | 2/1972 | Wilcox, Jr. et al. | |
| 3,850,362 | A | 11/1974 | Stollberg et al. | |
| 3,917,060 | A * | 11/1975 | Wood | B65D 5/00 206/187 |
| 4,981,258 | A | 1/1991 | Blanke | |
| 5,285,957 | A | 2/1994 | Halsell | |
| 6,109,513 | A | 8/2000 | Dugan | |
| 8,960,527 | B2 | 2/2015 | Hui | |
| 2005/0006446 | A1 | 1/2005 | Stafford, Jr. | |
| 2007/0218756 | A1 | 9/2007 | Takemoto et al. | |
| 2013/0026215 | A1 * | 1/2013 | Lenhard et al. | B65D 5/00 229/117.01 |
| 2016/0039560 | A1 | 2/2016 | Sharp | |

* cited by examiner

RAPIDLY ERECTED AND COLLAPSIBLE CONTAINER AND METHOD OF USING SAME

FIELD OF THE INVENTION

Embodiments are in the field of containers. More particularly, embodiments disclosed herein relate to rapidly erected and/or collapsible containers and methods of using same which, inter alfa, foster a container that rapidly transitions from a flat configuration to being ready for use in a box configuration. The container may be produced using less material without compromising the effectiveness and the structural integrity of the container.

BACKGROUND OF THE INVENTION

There are several challenges that are associated with common containers used in packaging, shipping, moving, etc. A typical container uses flaps, which overlap and interlock with each other, to: (i) provide structural rigidity to the container; and to (ii) serve as a bottom side or as a base panel of the container. Interlocking or interconnecting these flaps consumes by far most of the time required to erect a typical container, so that it is ready for use. Furthermore, excess material is required to produce a typical container due to the requirement of, inter alfa, an abundance of material for the overlapping flaps, which: (i) have a total aggregate area greater than the area of the base of the container and (ii) are often required to be thicker in order to provide sufficient structural rigidity.

To address the previous challenges, a number of alternative containers (e.g., cartons, boxes, packages, etc.) have been proposed. These alternative containers either rely on additional side walls (e.g., a container with six side walls) or require having folding side walls, which can be folded onto the base of the container. However, these features usually compromise structural integrity. For example, it is difficult to maintain these alternative containers fully erected (i.e., in a box configuration) without substantially filling them. Moreover, the folding side walls of these alternative containers often collapse when other containers or heavy loads are stacked on top.

Thus, it is desirable to provide a container and method of using same that are able to overcome the above disadvantages.

Advantages of the present invention will become more fully apparent from the detailed description of the invention hereinbelow.

SUMMARY OF THE INVENTION

Embodiments are directed to a container movable between a flat configuration and a box configuration different from the flat configuration. The container comprises two primary panels, two secondary panels, and a main link part movably coupled to the two primary panels via primary-link hinges. The main link part comprises at least three link portions movably coupled to each other via link-link hinges. The two primary panels are configured to move away and sideways from each other when the container is moved from the flat configuration to the box configuration. The two primary panels face each other across a gap, and the two secondary panels face each other across the gap, when the container is in the box configuration.

Embodiments are also directed to a method of using a container that is movable between a flat configuration and a box configuration different from the flat configuration. The method comprises providing a container comprising two primary panels, two secondary panels, and a main link part movably coupled to the two primary panels via primary-link hinges. The main link part comprises at least three link portions movably coupled to each other via link-link hinges. The method also comprises moving the container from the flat configuration to the box configuration, wherein the two primary panels move away and sideways from each other. The two primary panels face each other across a gap, and the two secondary panels face each other across the gap, when the container is in the box configuration.

Additional embodiments and additional features of embodiments for the container and method of using the container are described below and are hereby incorporated into this section.

BRIEF DESCRIPTION OF THE DRAWINGS

The detailed description will refer to the following drawings, wherein like reference numerals refer to like elements, and wherein.

DETAILED DESCRIPTION OF THE INVENTION

Figure 1A:
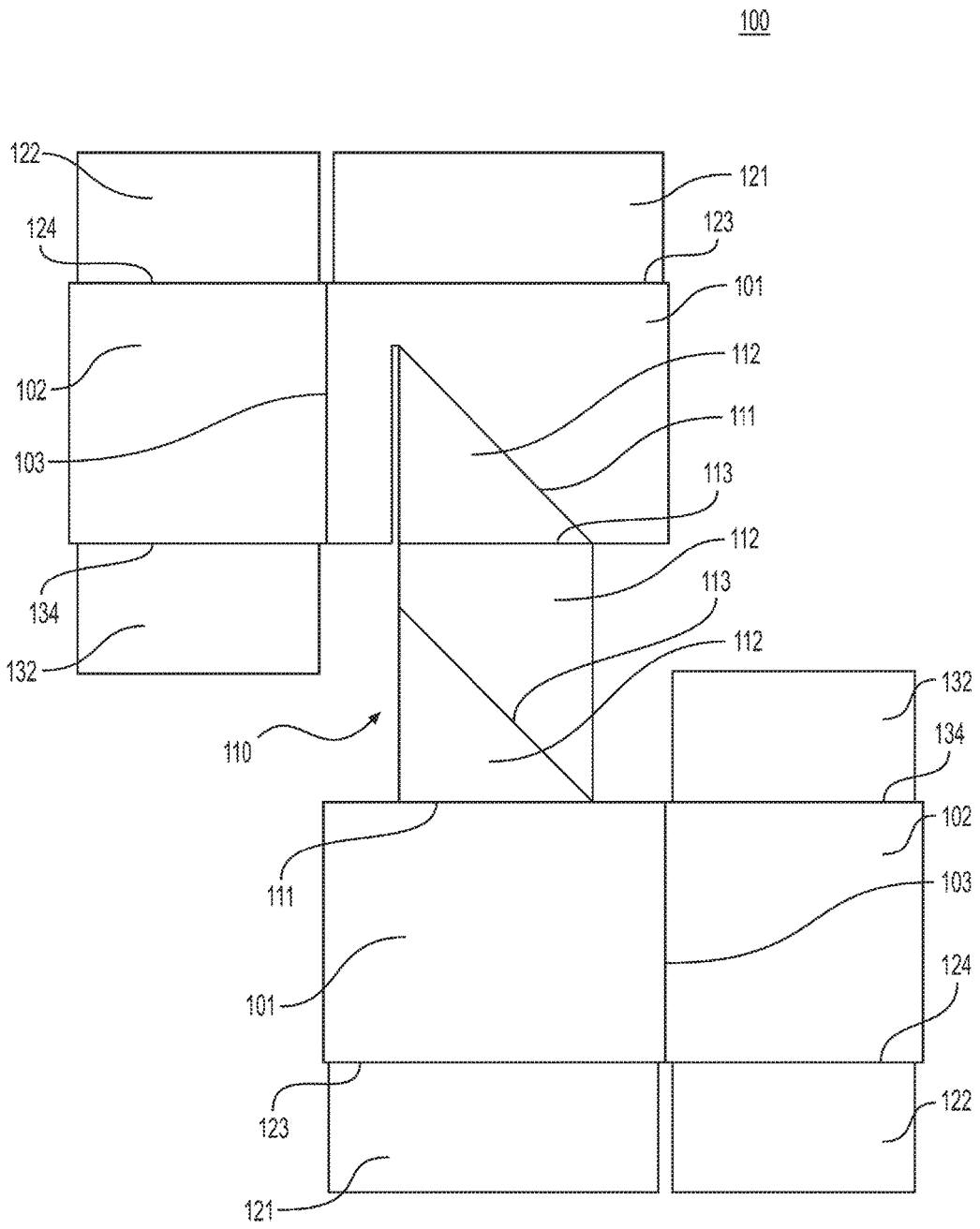
FIG. 1A is a diagram illustrating a plan view of an embodiment of a container, wherein the container is unassembled and two of four panel hinges are not connected for purposes of illustration and explanation only. The container includes two primary panels, two secondary panels, a main link part movably coupled to the two primary panels, and at least one secondary bottom flap.

It is to be understood that the figures and descriptions of the present invention may have been simplified to illustrate elements that are relevant for a clear understanding of the present invention, while eliminating, for purposes of clarity, other elements found in a typical container or typical method of using a container. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

For purposes of this disclosure, the term "planar" refers to an element or combination of elements that may have any thickness, and having sides defining the thickness that are parallel with each other.

Embodiments are directed to a container movable between a flat configuration and a box configuration different from the flat configuration. The container comprises two primary panels, two secondary panels, and a main link part. The main link part is movably coupled to the two primary panels via primary-link hinges. The main link part comprises at least three link portions movably coupled to each other via link-link hinges. The two primary panels are configured to move away and sideways from each other when the container is moved from the flat configuration to the box configuration. The two primary panels face each other across a gap, and the two secondary panels face each other across the gap, when the container is in the box configuration.

The two primary panels and the two secondary panels may serve as the side panels of the container. Furthermore, the main link part may serve, at least partly, as a base panel and may provide support/rigidity when the container is in the box configuration. When the container is in the flat configuration, the container may lie substantially in a single plane.

The container may be used for packaging (e.g., consumer products, electronics, cosmetics, pharmaceuticals, food, etc.), for shipping (e.g., mail, domestic shipping, overseas shipping, transfers, deliveries, etc.), for moving (e.g., residential, commercial, etc.), and for storage (e.g., products, belongings, tools, material, etc.), or other suitable uses. The uses of the container are abundant and the wide spectrum of users may include manufacturers, packaging companies, distributors (e.g., fulfillment centers, warehouses, storage facilities, etc.), shipping companies, and the end-consumers (e.g., to store belongings, to move contents of an end-consumer's residence, to ship items via a mail shipping or delivery company, etc.).

The composition of the container may vary. The container is foldable, movable, and collapsible. Moreover, portions and various hinges of the container may be required to bend when the container is moved from the flat configuration to the box configuration, or moved from the box configuration to the flat configuration. Thus, portions or all of the container may comprise a suitable flexible material that allows for folding, collapsing, and moving such as cardboard, paperboard, paper, corrugated carton, plastic, corrugated plastic, polymers, metal, or combinations thereof In addition, the container may comprise a plurality of different suitable materials. For example, the material of the main link part may be different than the material of the two primary panels or the material of the two secondary panels. The material of any portion of the container may be chosen for reusability of the container, or, alternatively, the material may be chosen based on a disposable (i.e., a one-time or limited use) variation.

The size, dimensions, thickness, shape, and weight of the container or portions of the container may vary. The two primary panels, the two secondary panels, and the main link part may be configured based on the desired overall features of the container and/or contents to be contained within the container. Hence, the size, dimensions, thickness, shape and weight of the two primary panels, of the two secondary panels, and of the main link part may vary. Moreover, the position, the length and the orientation of the primary-link hinges and of the link-link hinges may be configured based on the desired overall features of the container.

The manufacturing and the assembly of the container may vary. Desired objectives for the manufacturing and assembly processes may include reducing material costs, reducing manufacturing costs, reducing material waste, reducing manufacturing complexity, reducing shipping costs, or a combination thereof. The container may be assembled by coupling (e.g., connecting or attaching) various portions of a single sheet of material (e.g., via hinge(s) and/or without a hinge). Alternatively, the container may be assembled by coupling (e.g., connecting or attaching) various portions of a plurality of independent sheets of material (e.g., via hinge(s) and/or without a hinge). Furthermore, portions or all of the container may comprise more than one layer of material. For example, multiple layers of material may be attached or glued to each other to form at least one of the two primary panels, at least one of the two secondary panels, and/or any other portion of the container.

Biasing towards the box configuration may be employed and may be provided by the elastic energy generated by bending portions of the container when the container is moved from a flat configuration to a box configuration. Initially, the container provides resistance when a user moves the container from a flat configuration to a box configuration. Then, the container snaps towards the box configuration. Similarly, biasing towards the flat configuration may be provided by the elastic energy generated by bending portions of the container when the container is moved from a box configuration to a flat configuration. Initially, the container provides resistance when a user moves the container from a box configuration to a flat configuration. Then, the container snaps towards the flat configuration. Alternatively, to effect biasing, the container may, for example, be manufactured or assembled with an amount of pre-stress. Such manufacturing methods capable of providing the pre-stressing or biasing may comprise, for example, pressing, creasing, etc. Other biasing mechanisms may include special hinges (e.g., binary hinges, spring hinges, etc.). Any of the hinges mentioned throughout this description may be replaced by these biasing-type hinges.

The box configuration of the container may be maintained, at least partially, by using an optional interlock mechanism. Alternatively, to maintain the box configuration, two or more portions of the container may be fixed to each other, for example, using a mechanism such as interconnecting flaps, using slits to insert and lock portions of the container, using friction-fit, etc. Furthermore, two different portions of the container may be connected via a fastening mechanism to maintain the container in the box configuration.

Exemplary Embodiments

FIG. 1A is a diagram illustrating a plan view of an embodiment of a container 100, wherein the container is unassembled and two of four panel hinges 103 are not connected for purposes of illustration and explanation only. The container includes two primary panels 101, two secondary panels 102, a main link part 110 movably coupled to the two primary panels 101, and at least one secondary bottom flap 132.

Figure 1B:
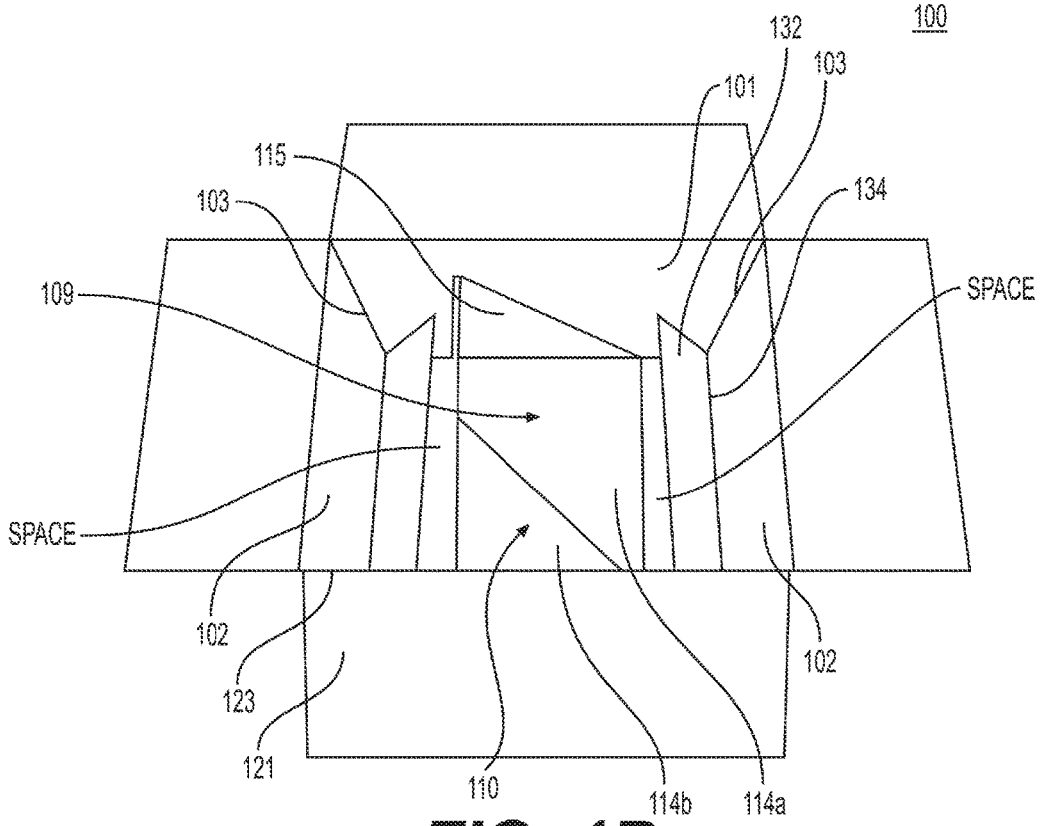
FIG. 1B is a diagram illustrating a perspective view of the container shown in FIG. 1A, wherein the container is assembled and in a box configuration. The at least one secondary bottom flap is not placed against the main link part for purposes of illustration and explanation only.

FIG. 1B is a diagram illustrating a perspective view of the container 100 shown in FIG. 1A, wherein the container is assembled and in a box configuration. The at least one secondary bottom flap 132 is not placed against the main link part 110 for purposes of illustration and explanation only.

Figure 1C:
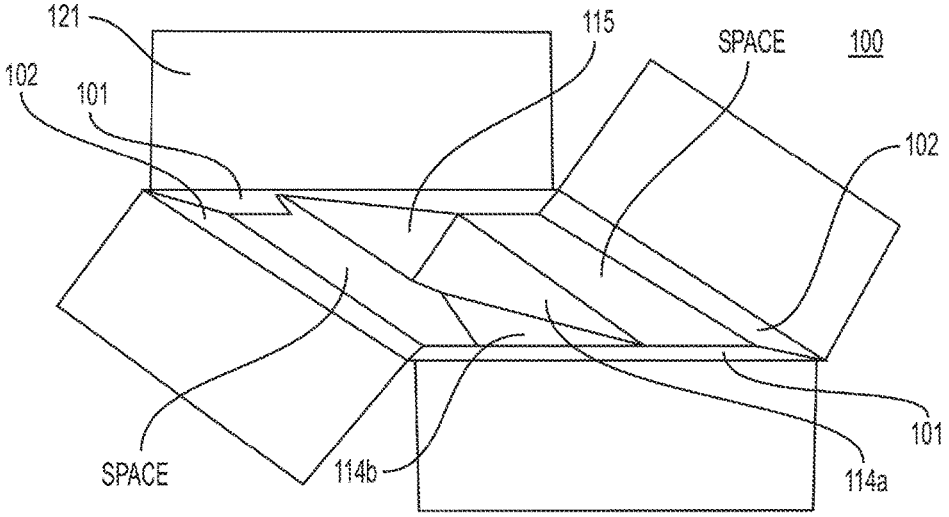
FIG. 1C is a diagram illustrating a plan view of the container shown in FIG. 1B, wherein the container is in a configuration that is between a flat configuration and a box configuration. The at least one secondary bottom flap is not shown for purposes of illustration and explanation only.

FIG. 1C is a diagram illustrating a plan view of the container 100 shown in FIG. 1B, wherein the container is in a configuration that is between a flat configuration and a box configuration. The at least one secondary bottom flap 132 is not shown for purposes of illustration and explanation only.

Figure 1D:
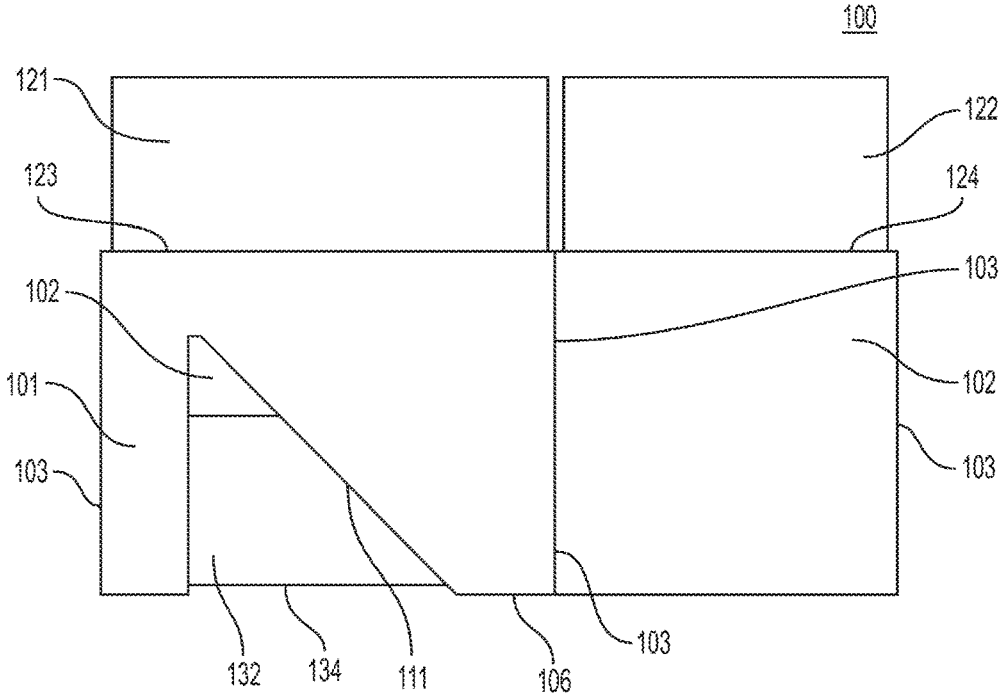
FIG. 1D is a diagram illustrating a side view of the container shown in FIG. 1B, wherein the container is in a flat configuration.

FIG. 1D is a diagram illustrating a side view of the container 100 shown in FIG. 1B, wherein the container 100 is in a flat configuration.

Figure 1E:
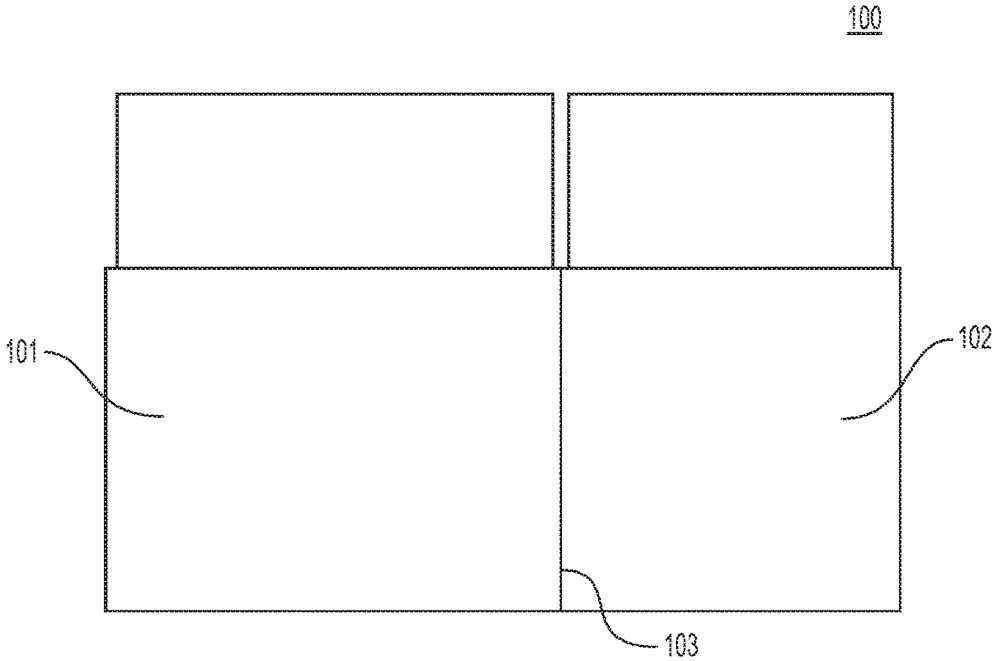
FIG. 1E is a diagram illustrating the other side view of the container shown in FIG. 1D.

FIG. 1E is a diagram illustrating the other side view of the container 100 shown in FIG. 1D.

Figure 1F:
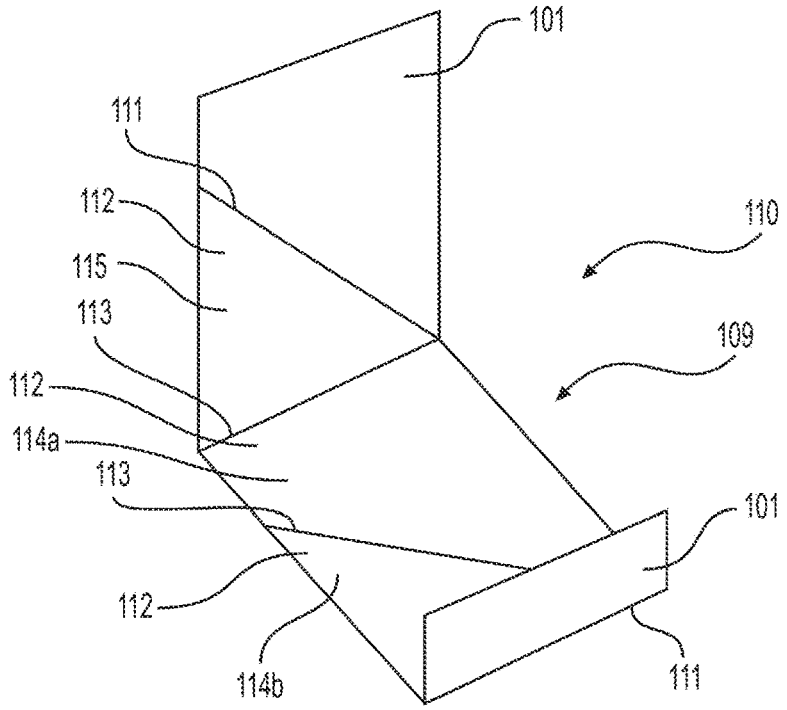
FIG. 1F is a diagram illustrating a perspective view of the main link part and portions of the two primary panels of the container shown in FIG. 1B.

FIG. 1F is a diagram illustrating a perspective view of the main link part 110 and portions of the two primary panels 101 of the container 100 shown in FIG. 1B.

Figure 1G:
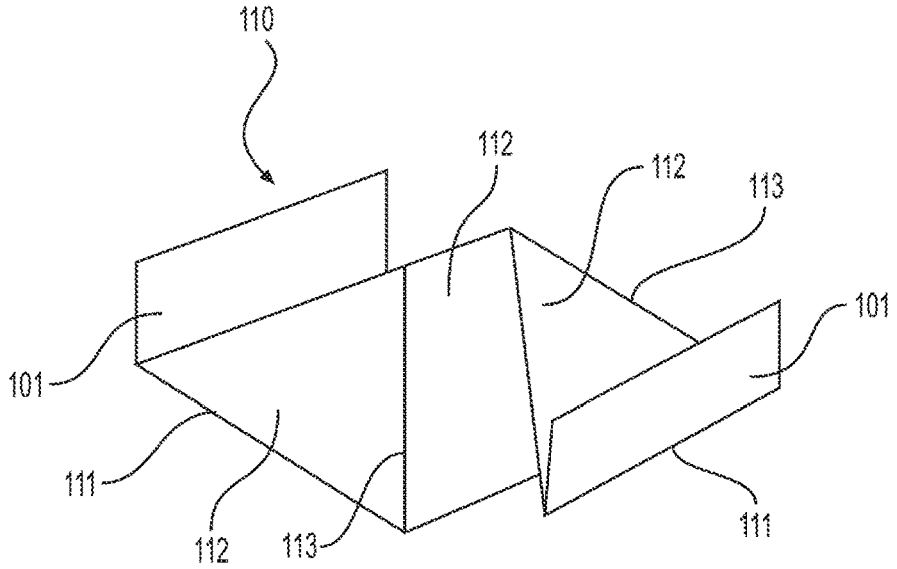
FIG. 1G is a diagram illustrating a perspective view of the main link part and portions of the two primary panels of the container shown in FIG. 1E, wherein the container is in a substantially flat configuration.

FIG. 1G is a diagram illustrating a perspective view of the main link part 110 and portions of the two primary panels 101 of the container 100 shown in FIG. 1E, wherein the container is in a substantially flat configuration.

With reference to FIGS. 1B-1G, the container 100 starts in a flat configuration, wherein the container 100 lies substantially in a single plane. The main link part 110 is folded and positioned between the two primary panels 101 which are movably coupled to the main link part 110 via primary-link hinges 111. The main link part 110 comprises at least three link portions 112 (which are also referred to as terminal portion 115, first link portion 114*a*, and second link portion 114*b*) movably coupled to each other via link-link hinges 113. Specifically, in the flat configuration, the terminal portion 115 and the first link portion 114*a* of the at least three link portions are aligned substantially within the same plane, while the second link portion 114*b* is folded onto the first link portion 114*a*. As the container is moved from the flat configuration to a box configuration, the two primary panels 101 move away and sideways from each other. In particular, the two primary panels 101 move clockwise with respect to each other when viewing the container from above (i.e., a plan view). The direction of motion of the two primary panels 101 may be reversed by suitably modifying the configuration and/or orientation of various components of the container. Also, as the container is moved from the flat configuration to the box configuration, the terminal portion 115 of the at least three link portions rotates clockwise for half a circle with respect to the adjacent primary panel via a primary-link hinge 111 when viewing the container from above (i.e., a plan view). Further, as the container is moved from the flat configuration to the box configuration, the link-link hinges 113 rotate towards the base of the container. In particular, the link-link hinge adjacent to the terminal portion 115 becomes a base or bottom edge of the container when the container is in the box configuration. Yet further, as the container is moved from the flat configuration to the box configuration, the first link portion 114*a* and second link portion 114*b* of the at least three link portions unfold from each other via a link-link hinge 113 and rotate towards the base of the container, thereby forming, at least partly, a base (or bottom) panel of the container. When the container is in the box configuration, the terminal portion 115 is aligned substantially within the same plane as its adjacent primary panel 101. Specifically, in the box configuration, the first link portion 114*a* and second link portion 114*b* of the at least three link portions form at least a portion of the base panel of the container, are aligned substantially within the same plane, and are substantially perpendicular to the terminal portion 115. Also, when the container is in the box configuration, the at least one secondary bottom flap 132 may be extended via at least one secondary-bottom hinge 134 and may be placed against the main link part 110, thereby forming an additional base section of the container. The at least one secondary bottom flap 132 may enable maintaining, at least partly, the container in the box configuration.

Figure 2A:
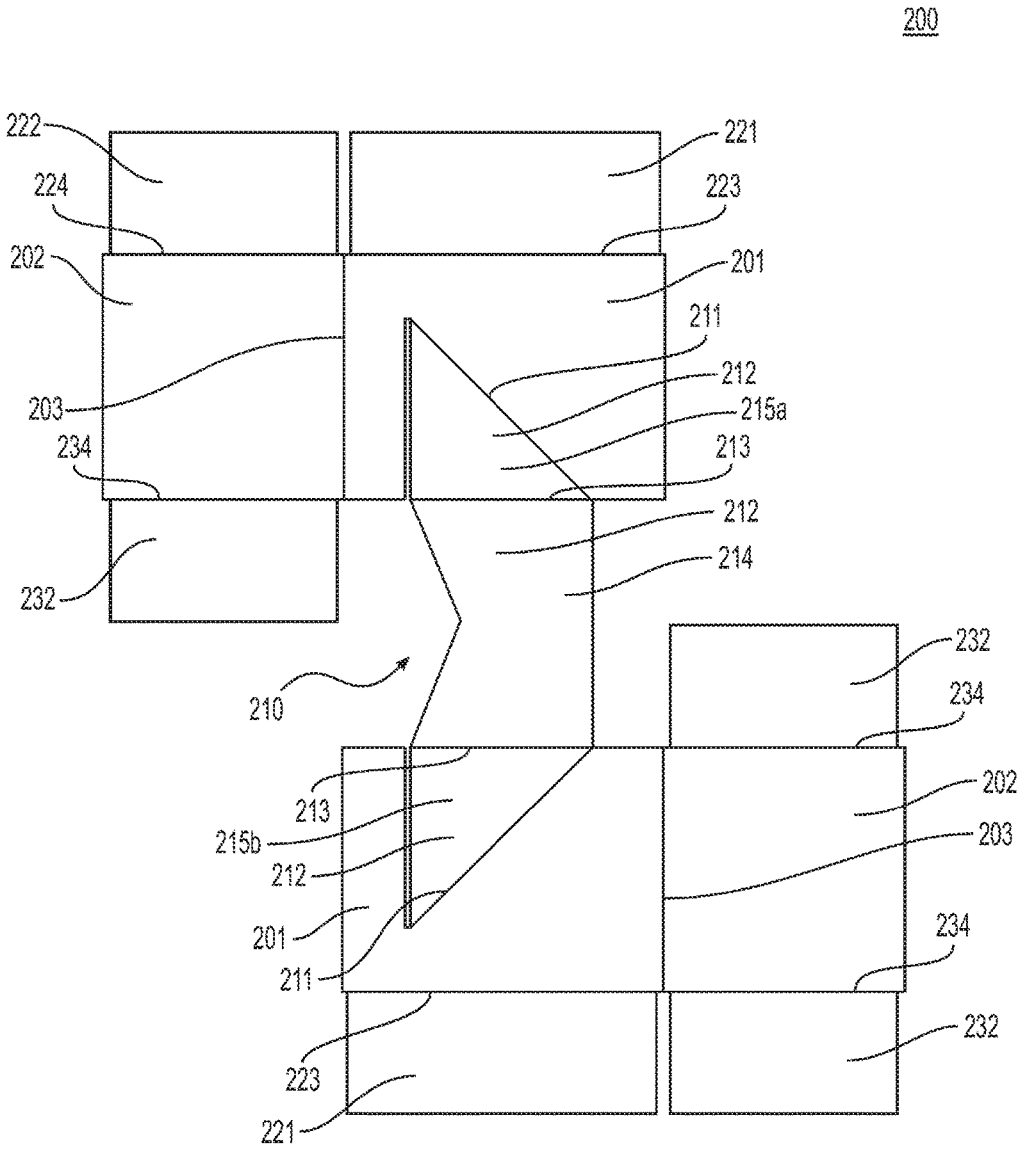
FIG. 2A is a diagram illustrating a plan view of an embodiment of a container, wherein the container is unassembled and two of four panel hinges are not connected for purposes of illustration and explanation only. The container includes two primary panels, two secondary panels, a main link part movably coupled to the two primary panels, and at least one secondary bottom flap.

FIG. 2A is a diagram illustrating a plan view of an embodiment of a container 200, wherein the container is unassembled and two of four panel hinges 203 are not connected for purposes of illustration and explanation only. The container includes two primary panels 201, two secondary panels 202, a main link part 210 movably coupled to the two primary panels 201, and at least one secondary bottom flap 232.

Figure 2B:
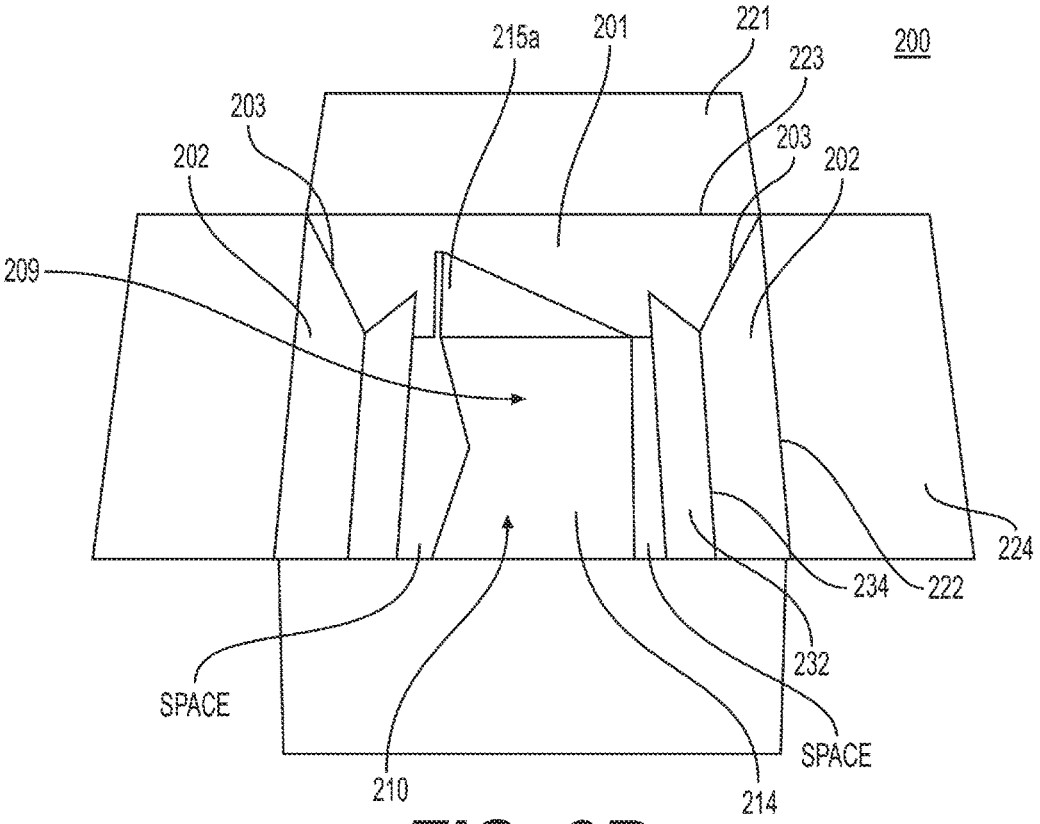
FIG. 2B is a diagram illustrating a perspective view of the container shown in FIG. 2A, wherein the container is assembled and in a box configuration. The at least one secondary bottom flap is not placed against the main link part for purposes of illustration and explanation only.

FIG. 2B is a diagram illustrating a perspective view of the container 200 shown in FIG. 2A, wherein the container is assembled and in a box configuration. The at least one secondary bottom flap 232 is not placed against the main link part 210 for purposes of illustration and explanation only.

Figure 2C:
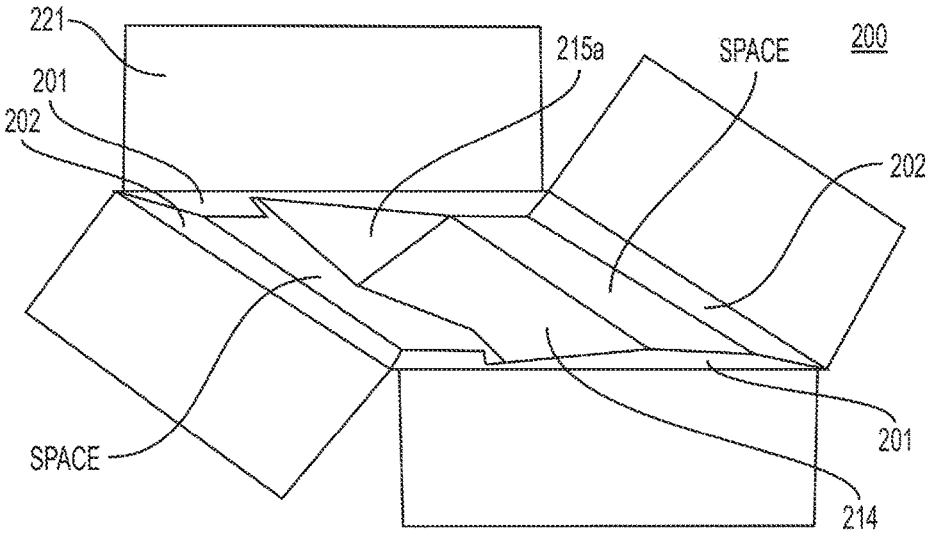
FIG. 2C is a diagram illustrating a plan view of the container shown in FIG. 2B, wherein the container is in a configuration that is between a flat configuration and a box configuration. The at least one secondary bottom flap is not shown for purposes of illustration and explanation only.

FIG. 2C is a diagram illustrating a plan view of the container 200 shown in FIG. 2B, wherein the container is in a configuration that is between a flat configuration and a box configuration. The at least one secondary bottom flap 232 is not shown for purposes of illustration and explanation only.

Figure 2D:
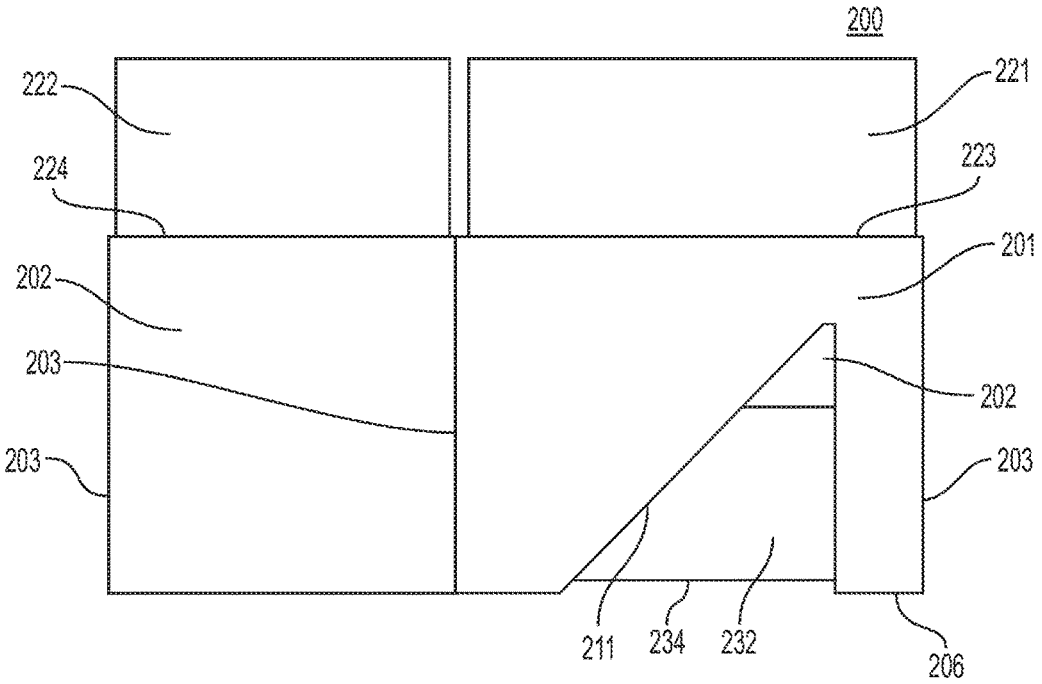
FIG. 2D is a diagram illustrating a side view of the container shown in FIG. 2B, wherein the container is in a flat configuration.

FIG. 2D is a diagram illustrating a side view of the container 200 shown in FIG. 2B, wherein the container is in a flat configuration.

Figure 2E:
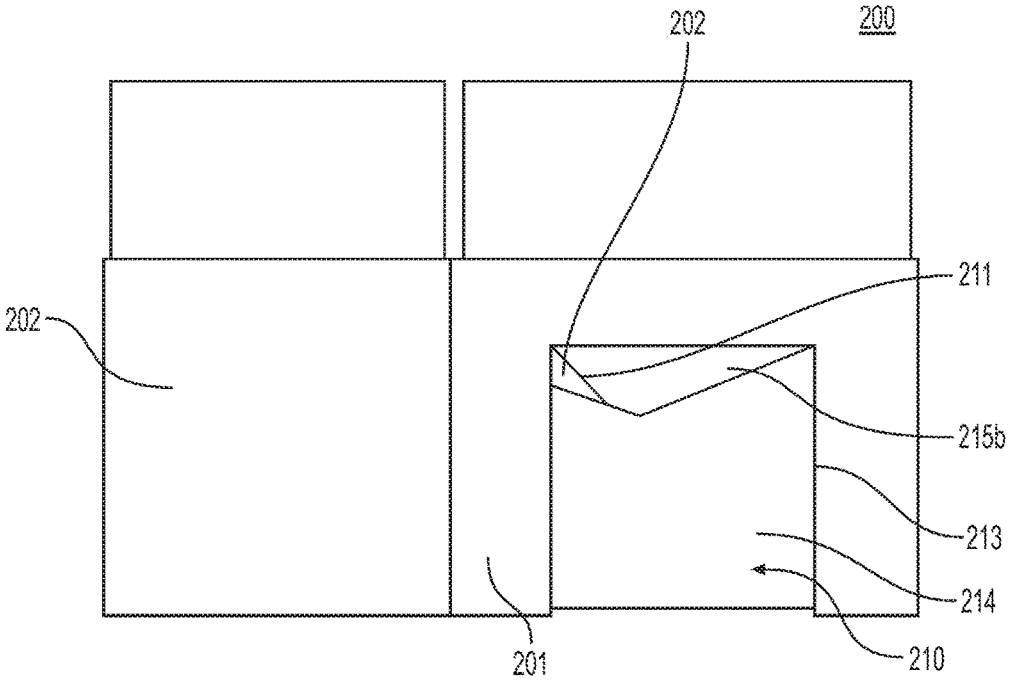
FIG. 2E is a diagram illustrating the other side view of the container shown in FIG. 2D.

FIG. 2E is a diagram illustrating the other side view of the container 200 shown in FIG. 2D.

Figure 2F:
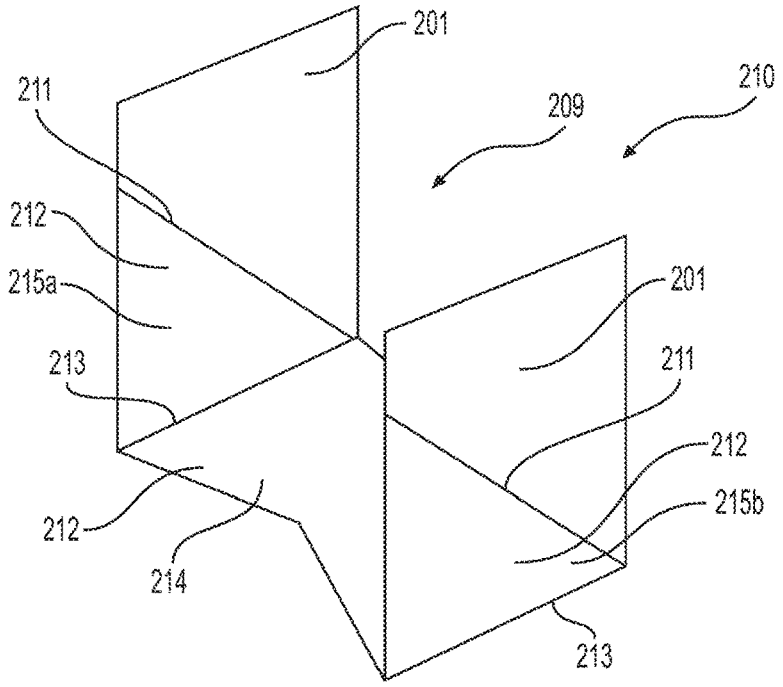
FIG. 2F is a diagram illustrating a perspective view of the main link part and portions of the two primary panels of the container shown in FIG. 2B.

FIG. 2F is a diagram illustrating a perspective view of the main link part 210 and portions of the two primary panels 201 of the container 200 shown in FIG. 2B.

Figure 2G:
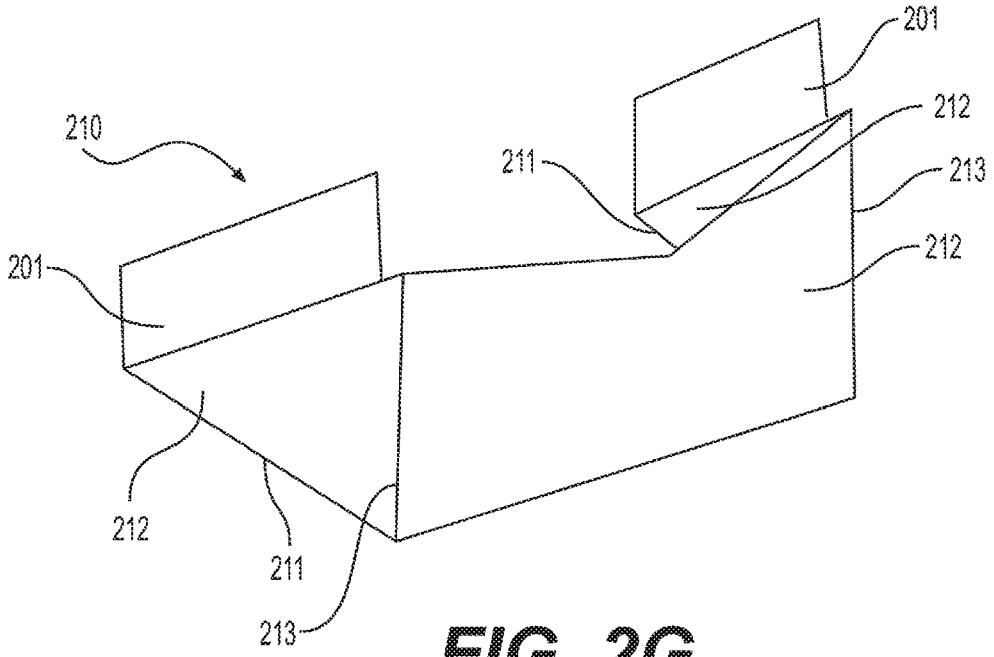
FIG. 2G is a diagram illustrating a perspective view of the main link part and portions of the two primary panels of the container shown in FIG. 2E, wherein the container is in a substantially flat configuration.

FIG. 2G is a diagram illustrating a perspective view of the main link part 210 and portions of the two primary panels 201 of the container 200 shown in FIG. 2E, wherein the container is in a substantially flat configuration.

With reference to FIGS. 2B-2G, the container 200 starts in a flat configuration, wherein the container 200 lies substantially in a single plane. The two primary panels 201 are movably coupled to the main link part 210 via primary-link hinges 211. The main link part 210 comprises at least three link portions 212 (which are also referred to as terminal portion 215*a*, link portion 214, and terminal portion 215*b*) movably coupled to each other via link-link hinges 213. Specifically, in the flat configuration, the link portion 214 and the terminal portion 215*a* of the at least three link portions are aligned substantially within the same plane, while the terminal portion 215*b* is folded onto the link portion 214. As the container is moved from the flat configuration to a box configuration, the two primary panels 201 move away and sideways from each other. In particular, the two primary panels 201 move clockwise with respect to each other when viewing the container from above (i.e., a plan view). Owing to the symmetry of the container 200, the direction of motion of the two primary panels 201 may simply be reversed (i.e., made to move counter-clockwise when viewing the container from above (i.e., a plan view)). Also, as the container is moved from the flat configuration to the box configuration, the terminal portion 215*a* of the at least three link portions rotates clockwise for half a circle with respect to a first of the two primary panels 201 via a primary-link hinge 211 when viewing the container from above (i.e., a plan view). Further, as the container is moved from the flat configuration to the box configuration, the link-link hinges 213 rotate towards the base of the container. The link-link hinges 213 form base or bottom edges of the container when the container is in the box configuration. Terminal portion 215*b* of the at least three link portions, which is folded onto the exterior of a second of the two primary panels 201 (i.e., not between the two primary panels 201) when the container is in the flat configuration, rotates clockwise for half a circle with respect to the second of the two primary panels 201 via another primary-link hinge 211 when viewing the container from above (i.e., a plan view) as the container is moved from the flat configuration to the box configuration. Yet further, as the container is moved from the flat configuration to the box configuration, the link portion 214 of the at least three link portions unfolds from the terminal portion 215*b* via a link-link hinge 213 and rotates towards the base of the container, thereby forming, at least partly, a base panel of the container. Also, when the container is in the box configuration, the terminal portions 215*a*, 215*b* are substantially parallel to each other and are each aligned substantially within the same plane as their respectively adjacent primary panel 201. Specifically, in the box configuration, the link portion 214 of the at least three link portions forms at least a portion of the base panel of the container and is substantially perpendicular to the terminal portions 215*a*, 215*b*. Further, when the container is in the box configuration, the at least one secondary bottom flap 232 may be extended via at least one secondary-bottom hinge 234 and may be placed against the main link part 210, thereby forming an additional base section of the container. The at least one secondary bottom flap 232 may enable maintaining, at least partly, the container in the box configuration.

Figure 3A:
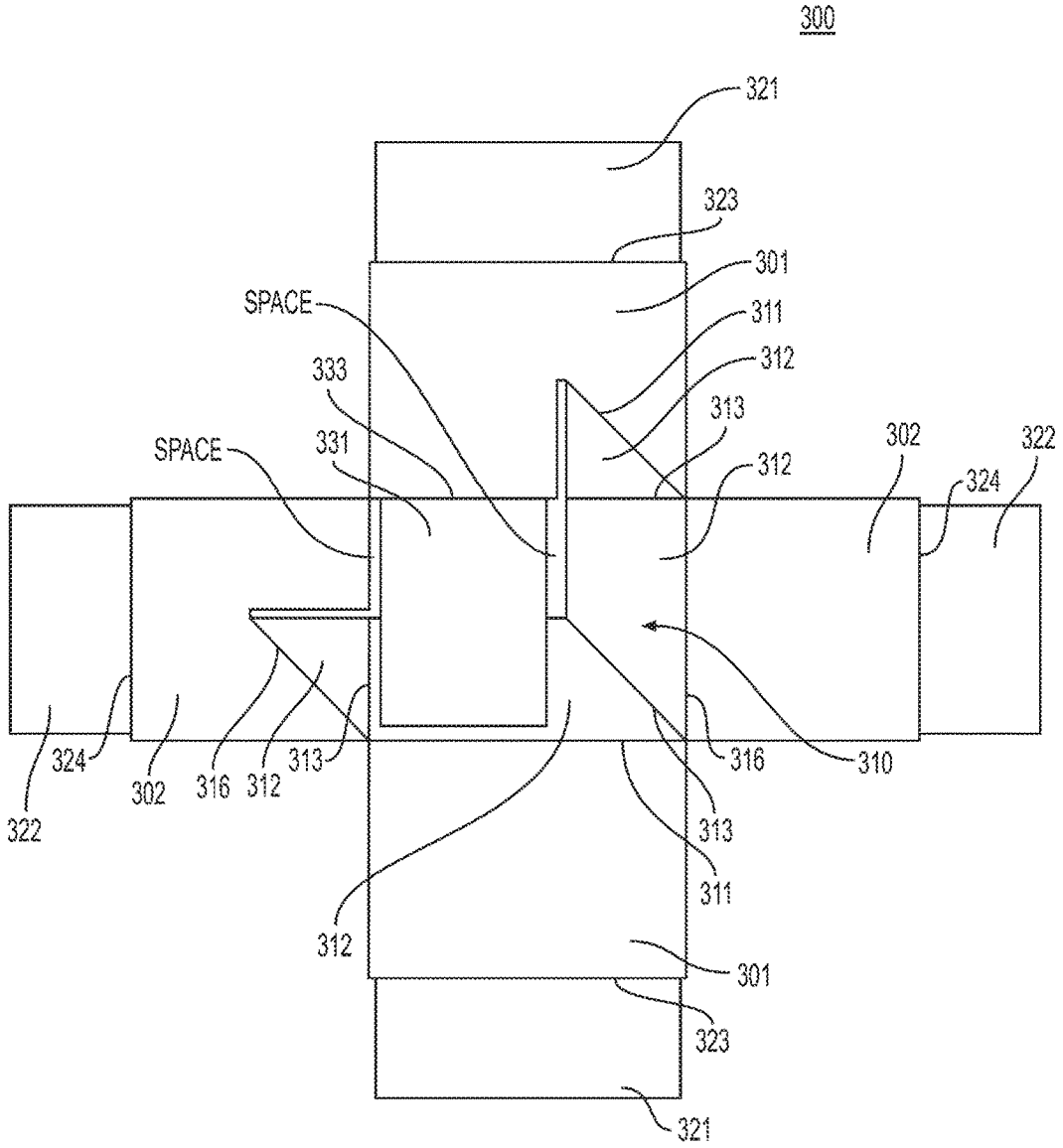
FIG. 3A is a diagram illustrating a plan view of an embodiment of a container, wherein the container is unassembled and four panel hinges are not connected for purposes of illustration and explanation only. The container includes two primary panels, two secondary panels, a main link part movably coupled to the two primary panels and to the two secondary panels, and a primary bottom flap.
Figure 3B:
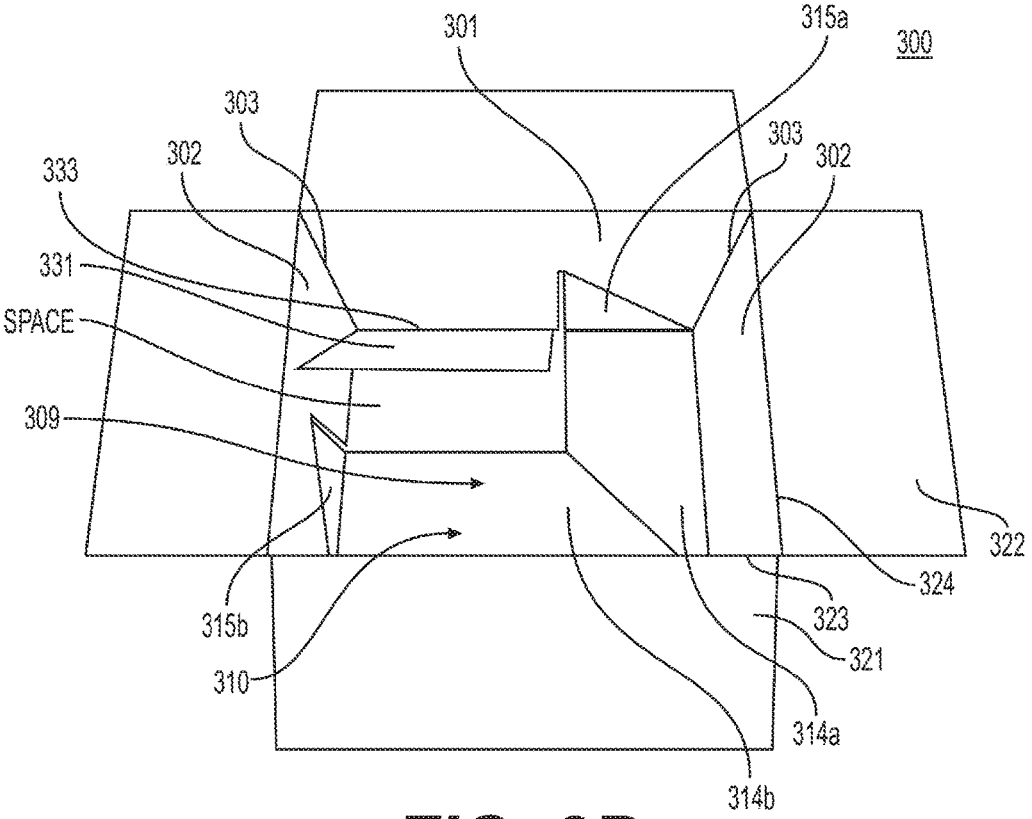
FIG. 3B is a diagram illustrating a perspective view of the container shown in FIG. 3A, wherein the container is assembled and in a box configuration. The primary bottom flap is not placed against the main link part for purposes of illustration and explanation only.

FIG. 3A is a diagram illustrating a plan view of an embodiment of a container 300, wherein the container is unassembled and four panel hinges 303 are not connected for purposes of illustration and explanation only (refer to FIG. 3B). The container includes two primary panels 301, two secondary panels 302, a main link part 310 movably coupled to the two primary panels 301 and to the two secondary panels 302, and a primary bottom flap 331.

FIG. 3B is a diagram illustrating a perspective view of the container 300 shown in FIG. 3A, wherein the container is assembled and in a box configuration. The primary bottom flap 331 is not placed against the main link part 310 for purposes of illustration and explanation only.

Figure 3C:
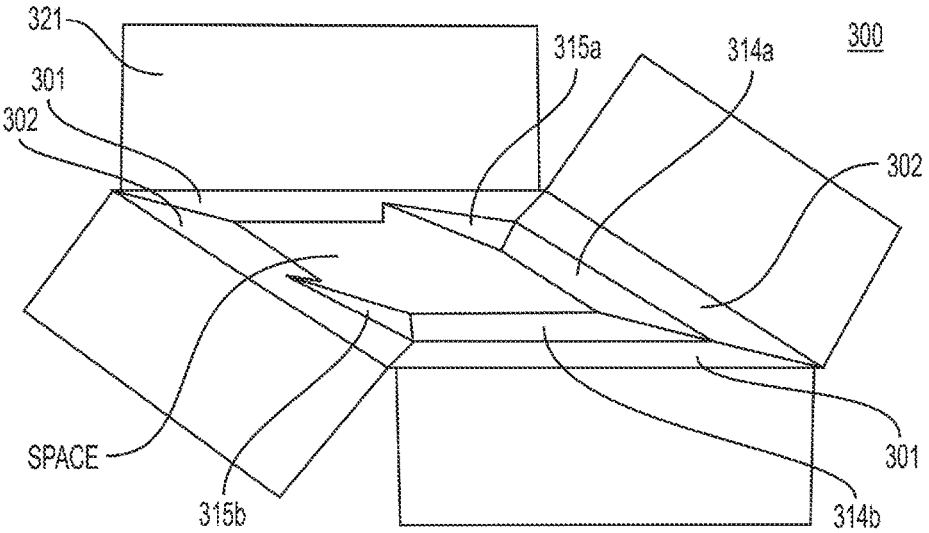
FIG. 3C is a diagram illustrating a plan view of the container shown in FIG. 3B, wherein the container is in a configuration that is between a flat configuration and a box configuration. The primary bottom flap is not shown for purposes of illustration and explanation only.

FIG. 3C is a diagram illustrating a plan view of the container 300 shown in FIG. 3B, wherein the container is in a configuration that is between a flat configuration and a box configuration. The primary bottom flap 331 is not shown for purposes of illustration and explanation only.

Figure 3D:
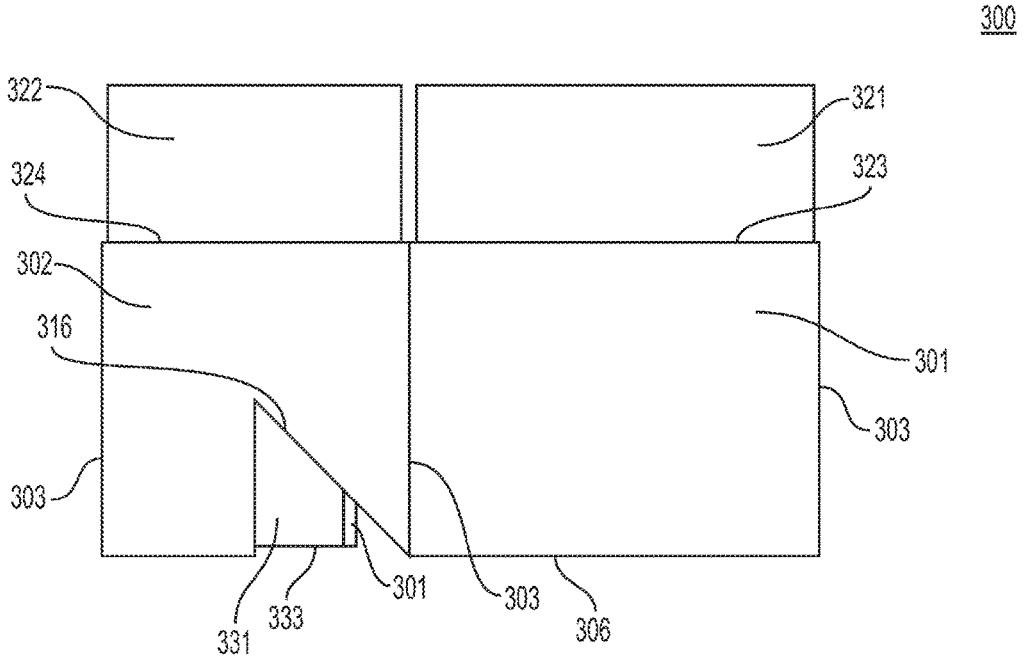
FIG. 3D is a diagram illustrating a side view of the container shown in FIG. 3B, wherein the container is in a flat configuration.

FIG. 3D is a diagram illustrating a side view of the container 300 shown in FIG. 3B, wherein the container is in a flat configuration.

Figure 3E:
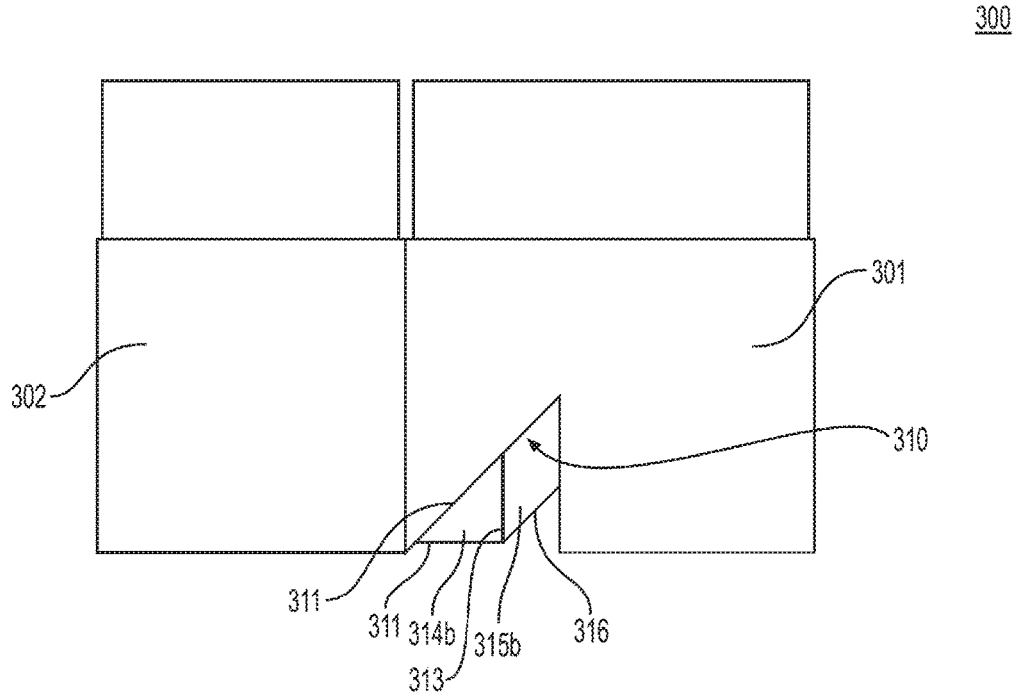
FIG. 3E is a diagram illustrating the other side view of the container shown in FIG. 3D.

FIG. 3E is a diagram illustrating the other side view of the container 300 shown in FIG. 3D.

With reference to FIGS. 3B-3E, the container 300 starts in a flat configuration, wherein the container 300 lies substantially in a single plane. The main link part 310 is folded and positioned between the two primary panels 301 which are movably coupled to the main link part 310 via primary-link hinges 311. The main link part 310 comprises at least four link portions 312 (which are also referred to as terminal portion 315*a*, first link portion 314*a*, second link portion 314*b*, and terminal portion 315*b* ) movably coupled to each other via link-link hinges 313. The main link part 310 is movably coupled to the two secondary panels 302 via secondary-link hinges 316. Specifically, in the flat configuration, the terminal portion 315*a* and the first link portion 314*a* of the at least four link portions are aligned substantially within the same plane, while the terminal portion 315*b* and the second link portion 314*b* are aligned substantially within the same plane. As the container is moved from the flat configuration to a box configuration, the two primary panels 301 move away and sideways from each other. In particular, the two primary panels 301 move clockwise with respect to each other when viewing the container from above (i.e., a plan view). The direction of motion of the two primary panels 301 may be reversed by suitably modifying the configuration and/or orientation of various components of the container. Also, as the container is moved from the flat configuration to the box configuration, the terminal portion 315*a* of the at least four link portions rotates clockwise for half a circle with respect to the adjacent primary panel 301 via a primary-link hinge 311 when viewing the container from above (i.e., a plan view). Further, as the container is moved from the flat configuration to the box configuration, the link-link hinges 313 rotate towards the base of the container. Two of the link-link hinges 313 form base or bottom edges of the container when the container is in the box configuration. Yet further, as the container is moved from the flat configuration to the box configuration, the first link portion 314*a* that is movably coupled to a first of the two secondary panels 302 via a secondary-link hinge 316 rotates away from the first of the two secondary panels 302. Yet further, as the container is moved from the flat configuration to the box configuration, the terminal portion 315*b* rotates counter-clockwise for half a circle with respect to a second of the two secondary panels 302 (i.e., essentially rotating away and then towards the second of the two secondary panels 302) via a secondary-link hinge 316 when viewing the container from above (i.e., a plan view). Yet further, as the container is moved from the flat configuration to the box configuration, the link portions 314*a*, 314*b* of the at least four link portions 312 unfold from each other via a link-link hinge 313 and rotate towards the base of the container, thereby forming, at least partly, a base panel of the container. When the container is in the box configuration, the terminal portions 315*a*, 315*b* are substantially perpendicular to each other, while terminal portion 315*a* is aligned substantially within the same plane as its adjacent primary panel 301, and while terminal portion 315*b* is aligned substantially within the same plane as its adjacent secondary panel 302. Specifically, in the box configuration, the link portions 314*a*, 314*b* of the at least four link portions are aligned substantially within the same plane, and are substantially perpendicular to the terminal portions 315*a*, 315*b* . Further, when the container is in the box configuration, the primary bottom flap 331 may be extended via a primary-bottom hinge 333 and may be placed against the main link part 310, thereby forming an additional base section of the container. The primary bottom flap 331 may enable maintaining, at least partly, the container in the box configuration.

Figure 4A:
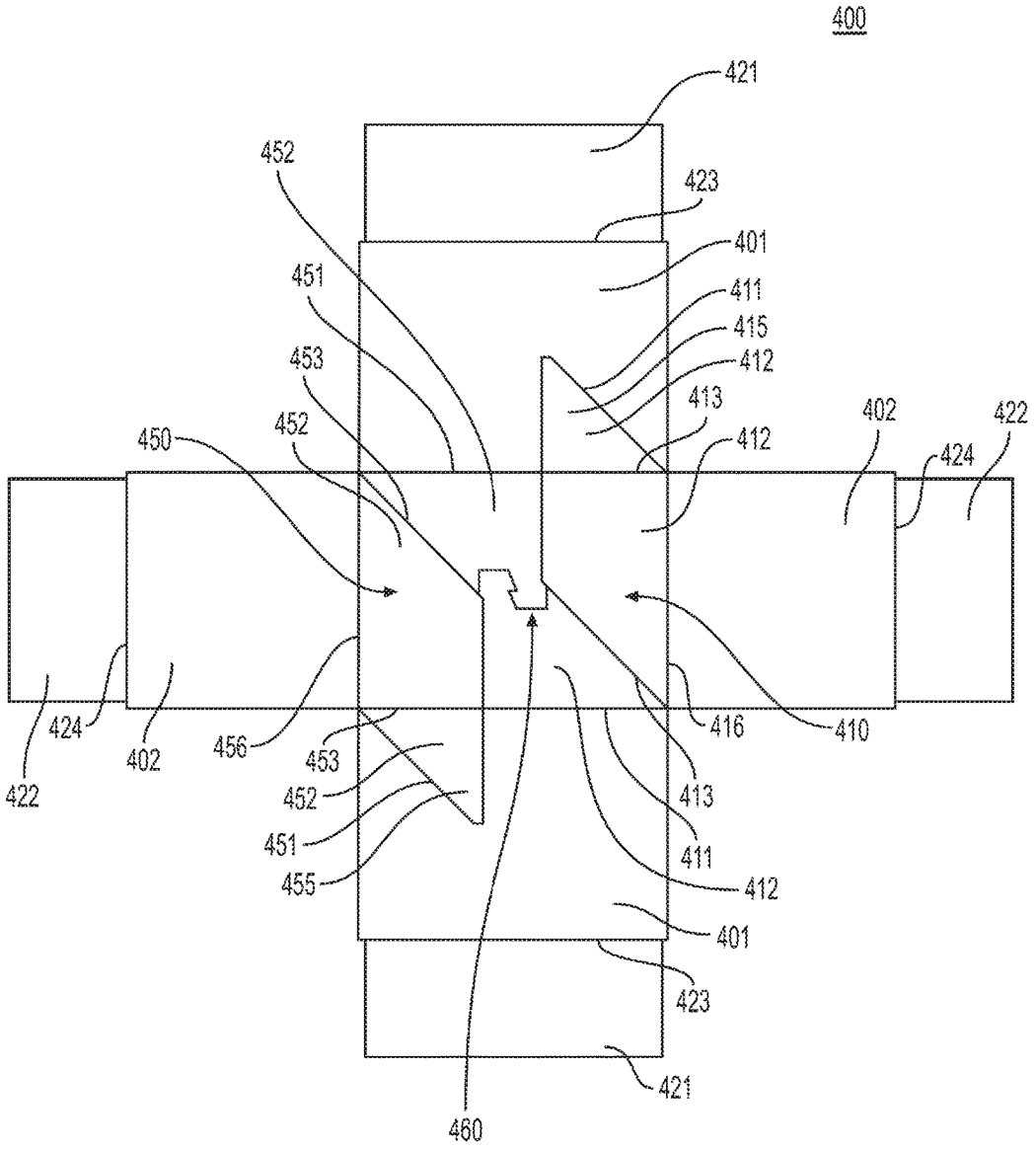
FIG. 4A is a diagram illustrating a plan view of an embodiment of a container, wherein the container is unassembled and four panel hinges are not connected for purposes of illustration and explanation only. The container includes two primary panels, two secondary panels, a main link part movably coupled to the two primary panels and to one of the two secondary panels, an additional link part movably coupled to the two primary panels and to the other one of the two secondary panels, and an optional interlock mechanism.
Figure 4B:
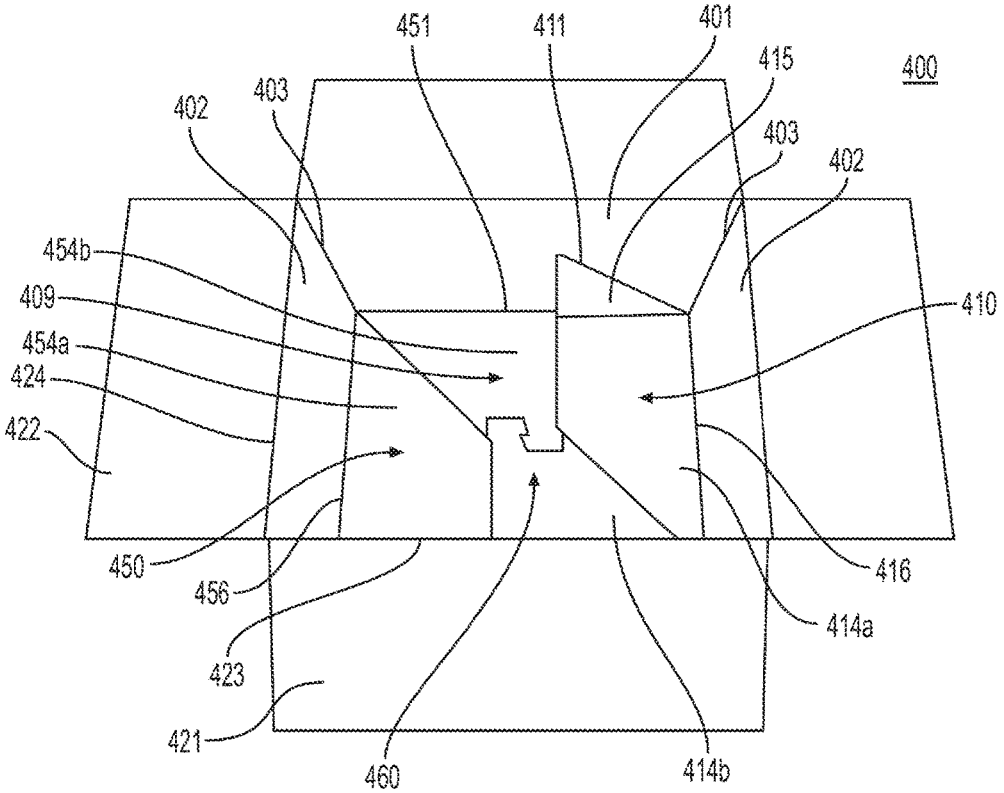
FIG. 4B is a diagram illustrating a perspective view of the container shown in FIG. 4A, wherein the container is assembled and in a box configuration.

FIG. 4A is a diagram illustrating a plan view of an embodiment of a container 400, wherein the container is unassembled and four panel hinges 403 are not connected for purposes of illustration and explanation only (refer to FIG. 4B). The container includes two primary panels 401, two secondary panels 402, a main link part 410 movably coupled to the two primary panels 401 and to one of the two secondary panels 402, an additional link part 450 movably coupled to the two primary panels 401 and to the other one of the two secondary panels 402, and an optional interlock mechanism 460.

FIG. 4B is a diagram illustrating a perspective view of the container 400 shown in FIG. 4A, wherein the container is assembled and in a box configuration.

Figure 4C:
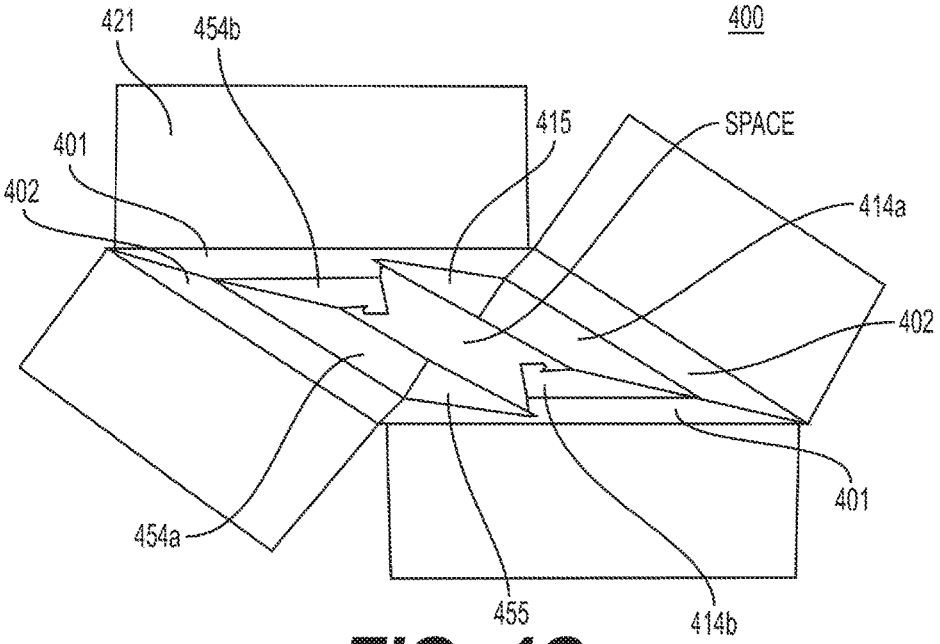
FIG. 4C is a diagram illustrating a plan view of the container shown in FIG. 4B, wherein the container is in a configuration that is between a flat configuration and a box configuration.

FIG. 4C is a diagram illustrating a plan view of the container 400 shown in FIG. 4B, wherein the container is in a configuration that is between a flat configuration and a box configuration.

Figure 4D:
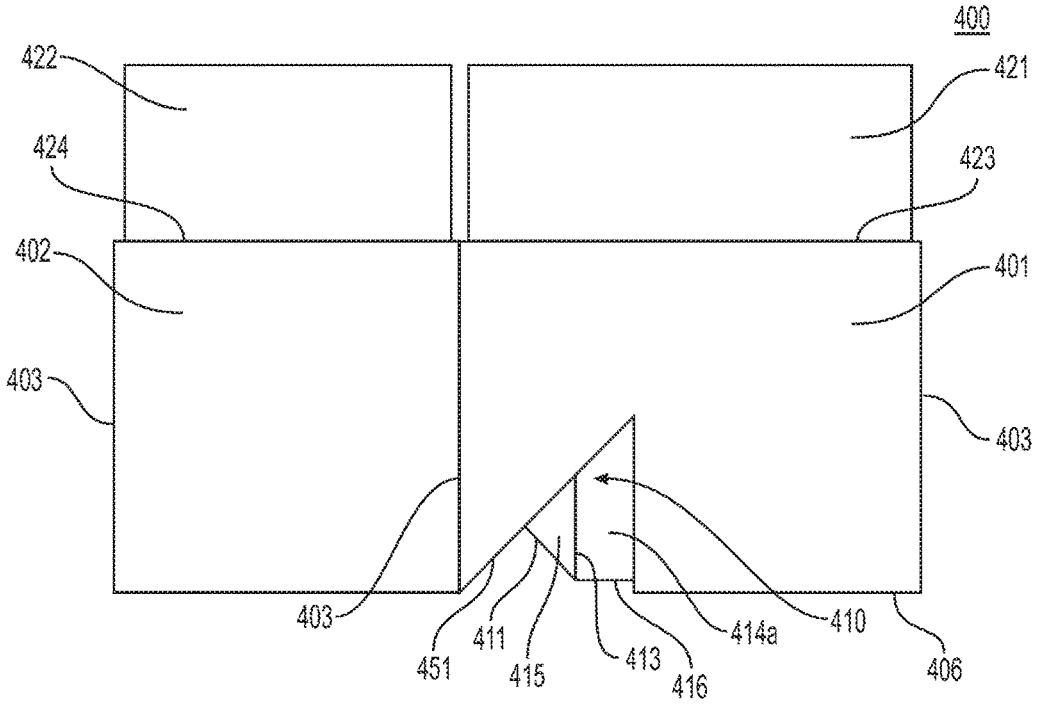
FIG. 4D is a diagram illustrating a side view of the container shown in FIG. 4B, wherein the container is in a flat configuration.

FIG. 4D is a diagram illustrating a side view of the container 400 shown in FIG. 4B, wherein the container is in a flat configuration.

Figure 4E:
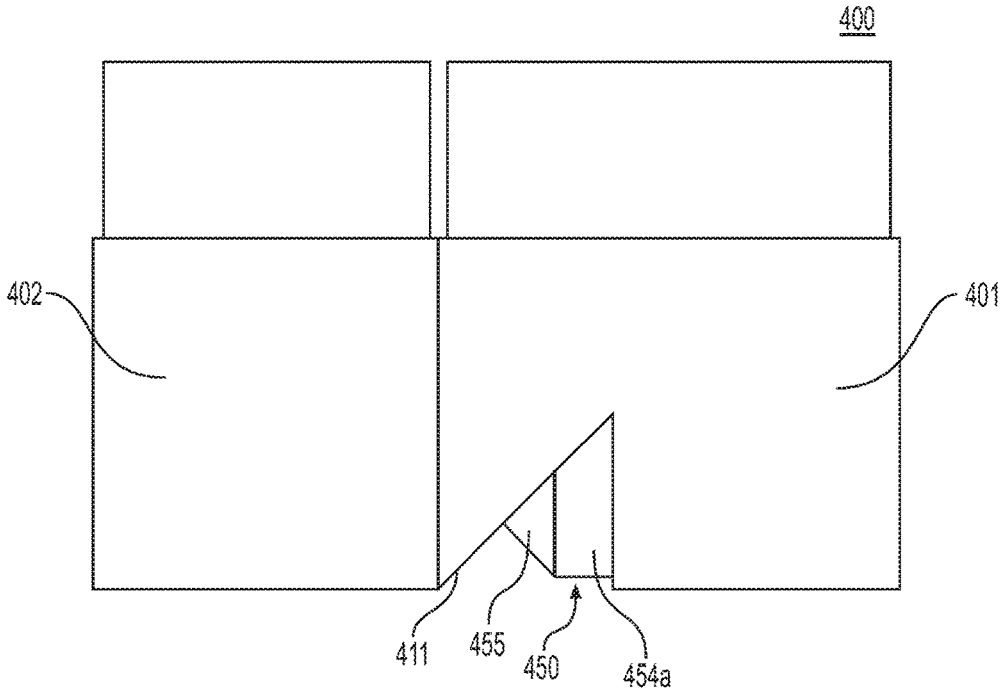
FIG. 4E is a diagram illustrating the other side view of the container shown in FIG. 4D.

FIG. 4E is a diagram illustrating the other side view of the container 400 shown in FIG. 4D.

Figure 4F:
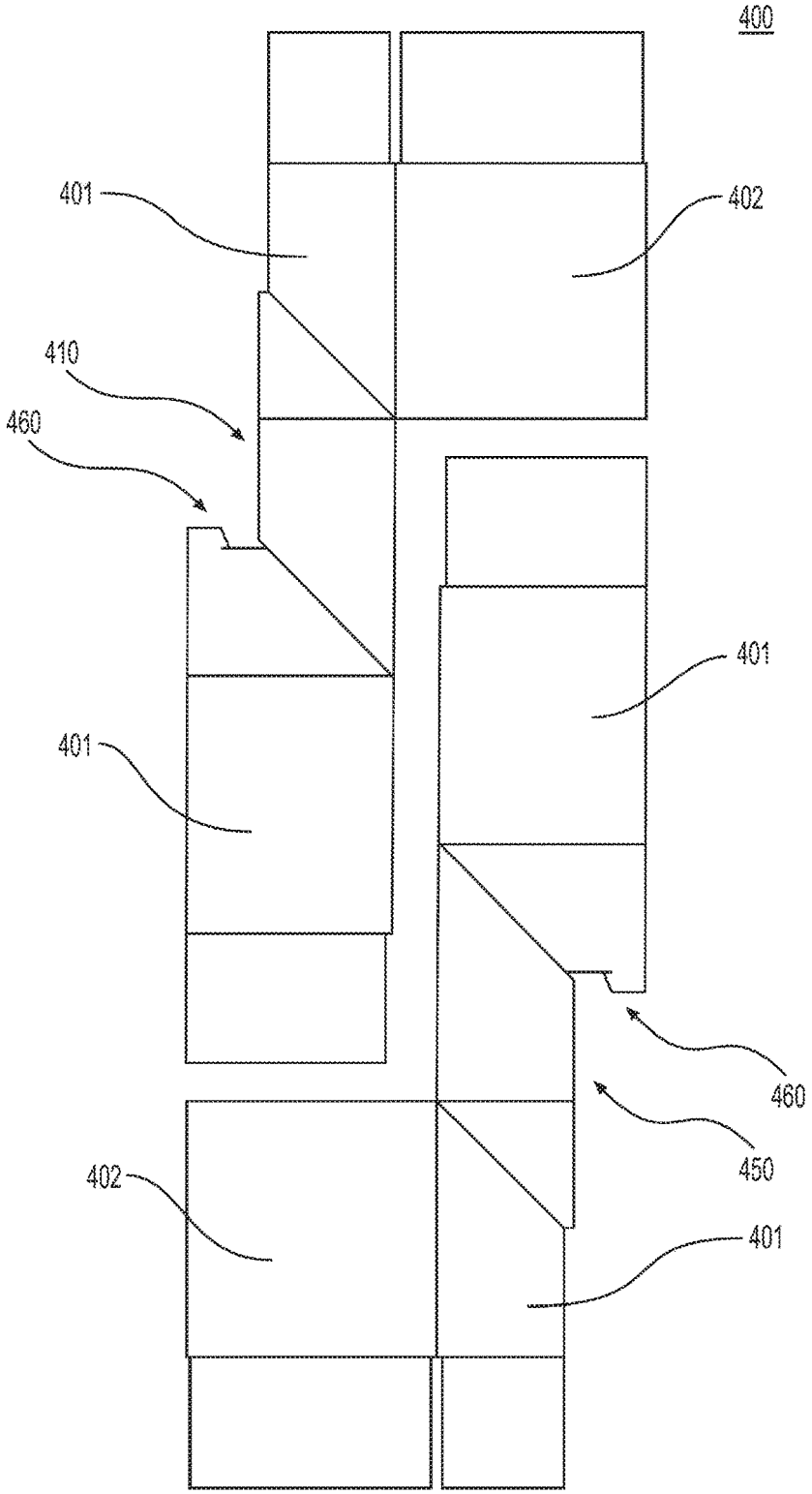
FIG. 4F is a diagram illustrating an alternative unassembled plan view of the container shown in FIG. 4B, wherein the container is assembled from a plurality of sheets of material.

FIG. 4F is a diagram illustrating an alternative unassembled plan view of the container 400 shown in FIG. 4B, wherein the container is assembled from a plurality of sheets of material.

Figure 4G:
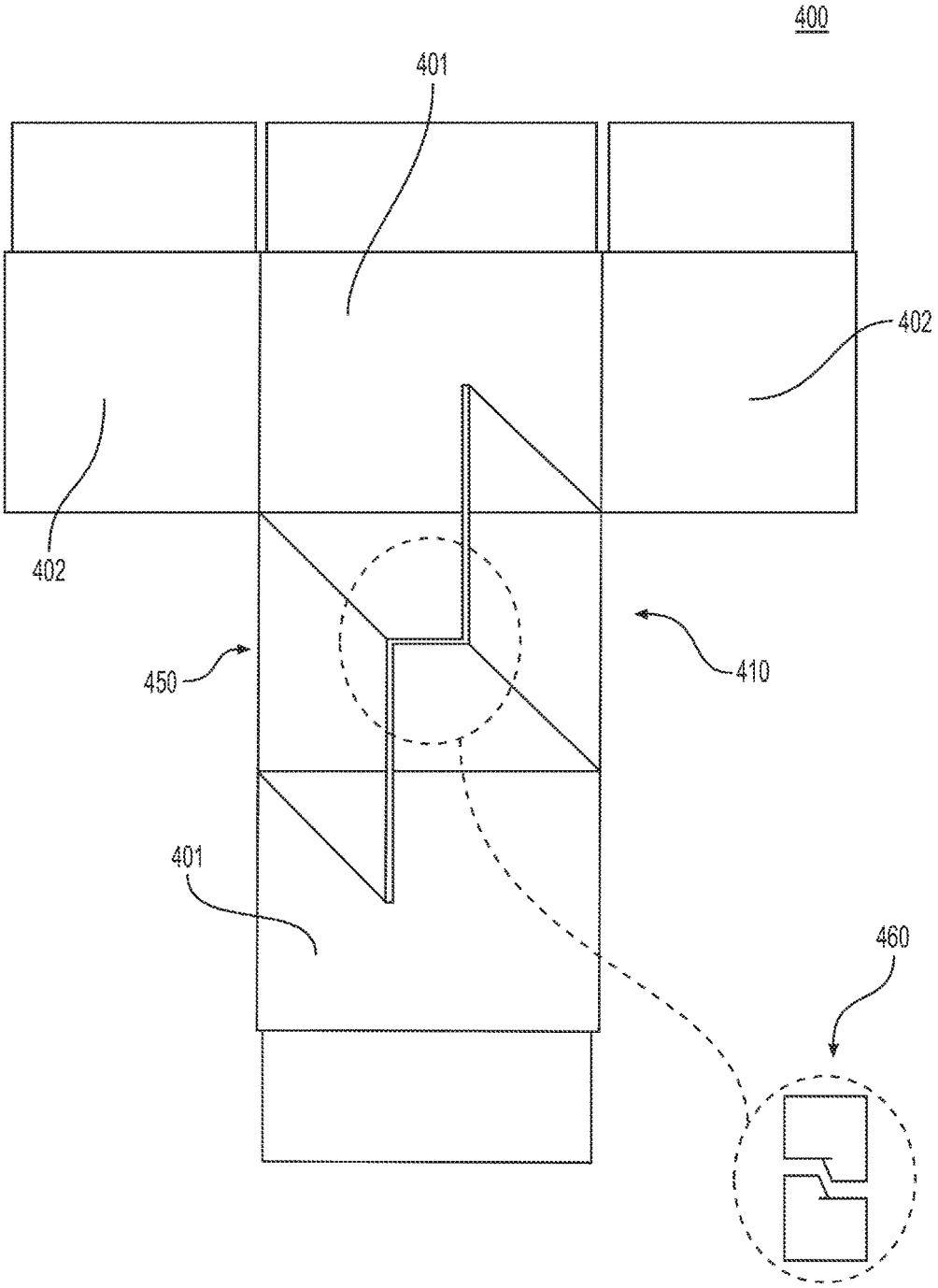
FIG. 4G is a diagram illustrating another alternative unassembled plan view of the container shown in FIG. 4B, wherein the optional interlock mechanism is an additional component coupled to the main link part and to the additional link part.

FIG. 4G is a diagram illustrating another alternative unassembled plan view of the container 400 shown in FIG. 4B, wherein the optional interlock mechanism 460 is an additional component coupled to the main link part 410 and to the additional link part 460.

Figure 4H:
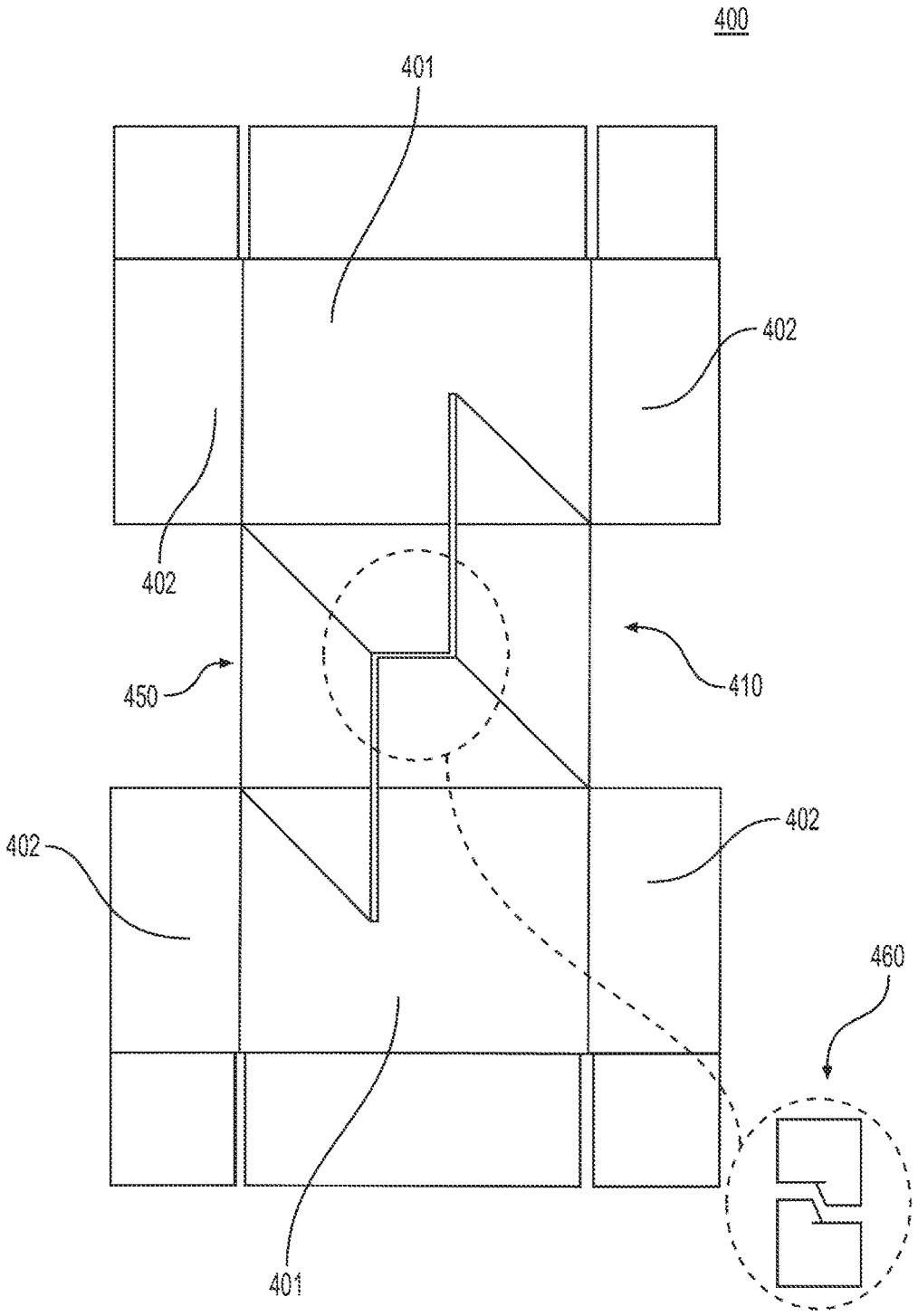
FIG. 4H is a diagram illustrating a further alternative unassembled plan view of the container shown in FIG. 4B, wherein the optional interlock mechanism is an additional component coupled to the main link part and to the additional link part, and wherein each of the two secondary panels comprises a plurality of portions.
Figure 4I:
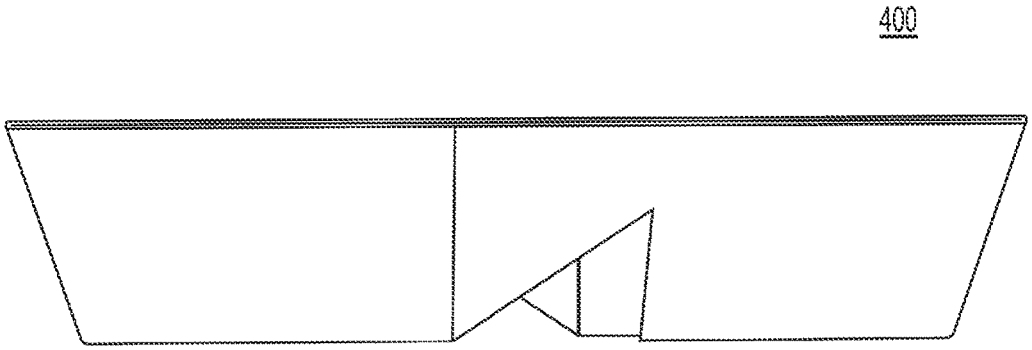
FIGS. 4I-4P is a sequence of diagrams illustrating two perspective views of four different stages of the container shown in FIG. 4G, i.e., when the container is assembled and moved from the flat configuration (FIGS. 4I and 4J), to the transition configurations (FIGS. 4K-4N), and to the box configuration (FIGS. 4O and 4P). The optional interlock mechanism and the top flaps are omitted for purposes of illustration and explanation only. And the height of the two primary panels and the height of the two secondary panels is smaller than the respective panel heights shown in FIG. 4G (once assembled) for purposes of illustration and explanation only.
Figure 4J:
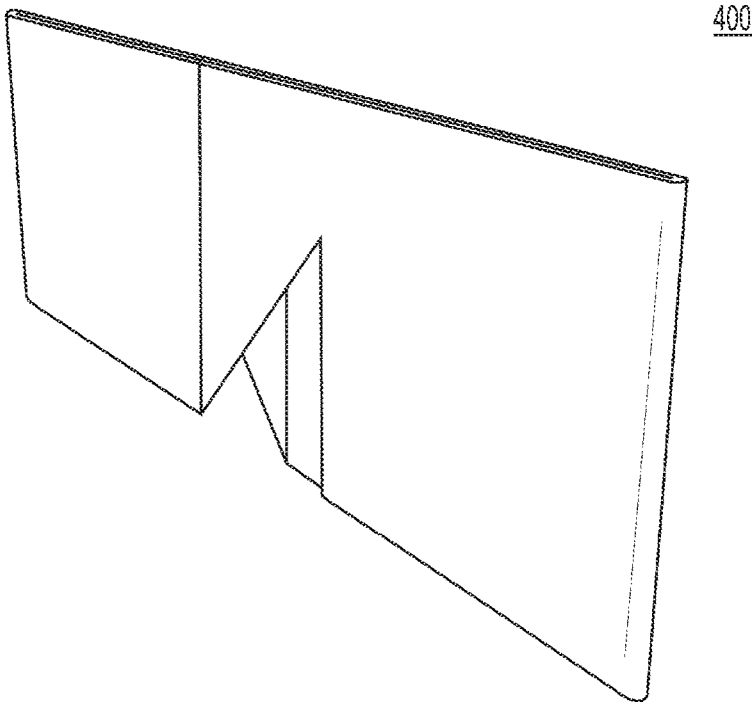
Figure 4K:
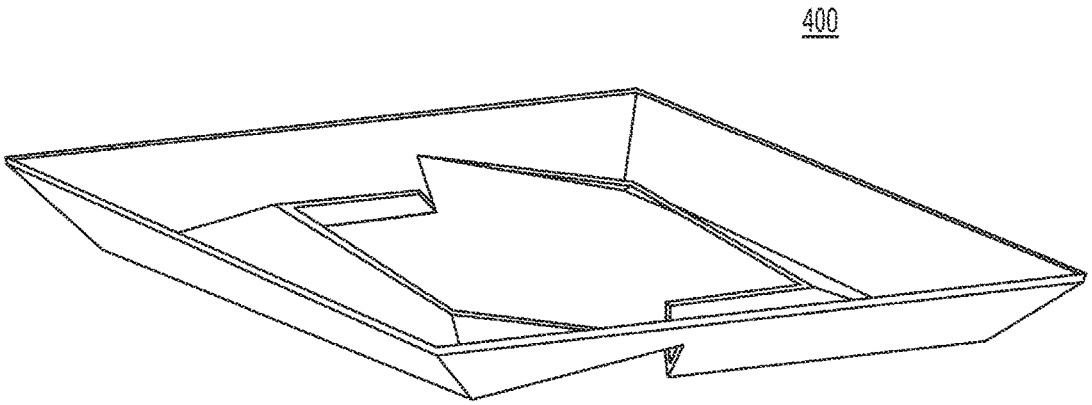
Figure 4L:
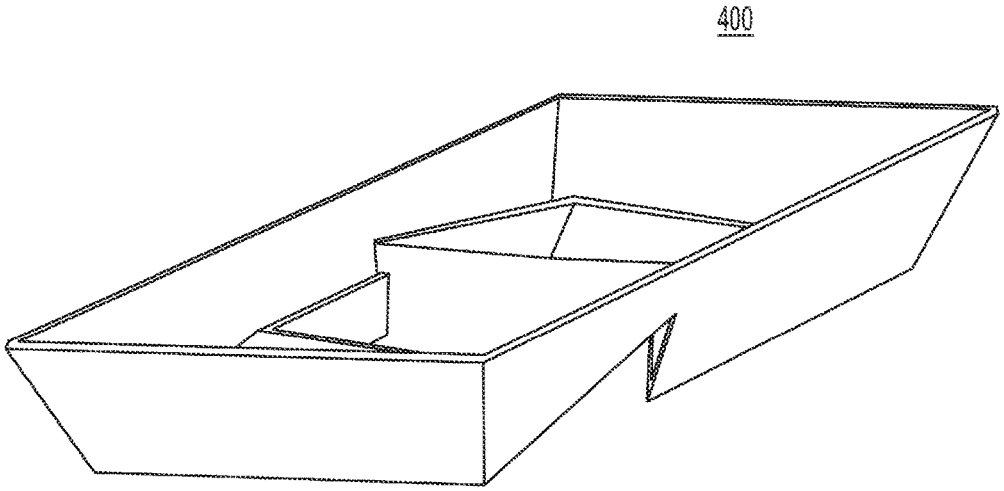
Figure 4M:
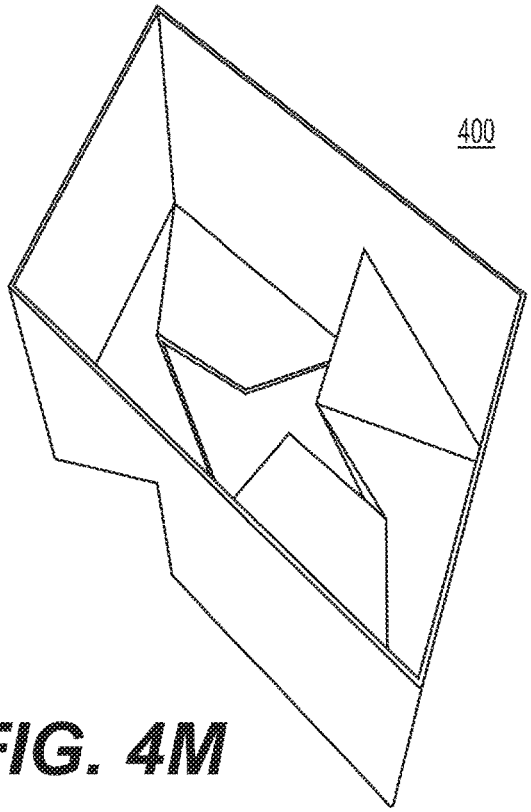
Figure 4N:
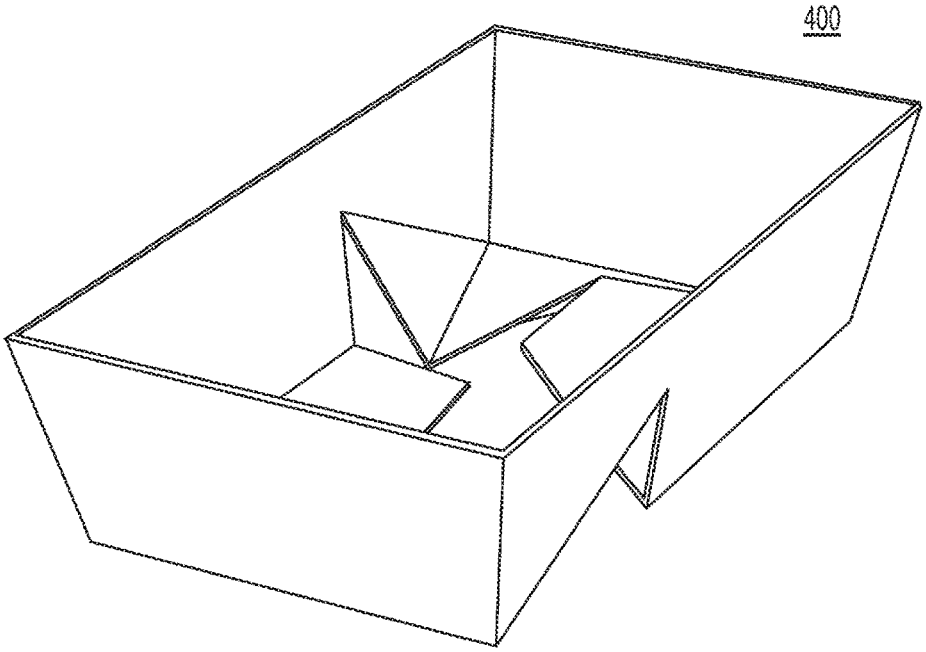

FIG. 4H is a diagram illustrating a further alternative unassembled plan view of the container 400 shown in FIG. 4B, wherein the optional interlock mechanism 460 is an additional component coupled to the main link part 410 and to the additional link part 460, and wherein each of the two secondary panels 402 comprises a plurality of portions.

Figure 4O:
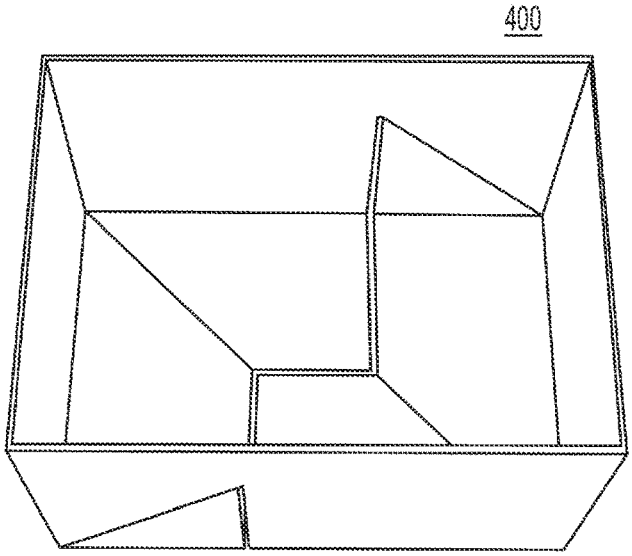
Figure 4P:
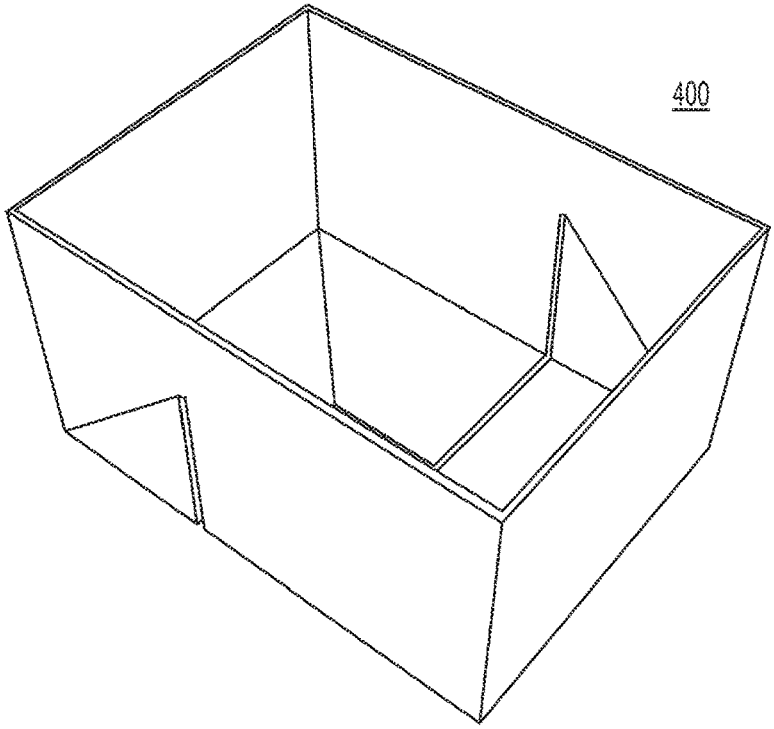

FIGS. 4I-4P is a sequence of diagrams illustrating two perspective views of four different stages of the container 400 using the (unassembled) version of the container shown in FIG. 4G, i.e., when the container is assembled and moved from the flat configuration (FIGS. 4I and 4J), to the transition configurations (FIGS. 4K-4N), and to the box configuration (FIGS. 4O and 4P). The optional interlock mechanism 460, the primary top flaps 421, and the secondary top flaps 422 are omitted for purposes of illustration and explanation only. And the height of the two primary panels 401 and the height of the two secondary panels 402 is smaller than the respective panel heights shown in FIG. 4G (once assembled) for purposes of illustration and explanation only.

With reference to FIGS. 4B-4P, the container 400 starts in a flat configuration, wherein the container 400 lies substantially in a single plane. The main link part 410 is folded and positioned between the two primary panels 401 which are movably coupled to the main link part 410 via primary-link hinges 411. The main link part 410 comprises at least three link portions 412 (which are also referred to as terminal portion 415, first link portion 414*a*, and second link portion 414*b*) movably coupled to each other via link-link hinges 413. The main link part 410 is movably coupled to one of the two secondary panels 402 via a secondary-link hinge 416. An additional link part 450 is also folded and positioned between the two primary panels 401 which are also movably coupled to the additional link part 450 via additional primary-link hinges 451. The additional link part 450 comprises at least three additional link portions 452 (which are also referred to as additional terminal portion 455, first additional link portion 454*a*, and second additional link portion 454*b*) movably coupled to each other via additional link-link hinges 453. The additional link part 450 is movably coupled to the other secondary panel 402 via an additional secondary-link hinge 456. Specifically, in the flat configuration, the terminal portion 415 and the first link portion 414*a* of the at least three link portions are aligned substantially within the same plane, while the second link portion 414*b* is folded onto the first link portion 414*a*. As the container is moved from the flat configuration to a box configuration, the two primary panels 401 move away and sideways from each other. In particular, the two primary panels 401 move clockwise with respect to each other when viewing the container from above (i.e., a plan view). The direction of motion of the two primary panels 401 may be reversed by suitably modifying the configuration and/or orientation of various components of the container. Also, as the container is moved from the flat configuration to the box configuration, the terminal portion 415 of the at least three link portions rotates clockwise for half a circle with respect to the adjacent primary panel 401 via a primary-link hinge 411 when viewing the container from above (i.e., a plan view). Further, as the container is moved from the flat configuration to the box configuration, the link-link hinges 413 rotate towards the base of the container. One of the link-link hinges becomes a base or bottom edge of the container when the container is in the box configuration. Yet further, as the container is moved from the flat configuration to the box configuration, the first link portion 414*a* that is movably coupled to an adjacent one of the two secondary panels 402 rotates away from the adjacent secondary panel 402 towards the base of the container via the secondary-link hinge 416. Yet further, as the container is moved from the flat configuration to the box configuration, the link portions 414*a*, 414*b* of the at least three link portions unfold from each other via a link-link hinge 413 and rotate towards the base of the container, thereby forming, at least partly, a base panel of the container. When the container is in the box configuration, the terminal portion 415 and the additional terminal portion 455 are substantially parallel to each other and are each aligned substantially within the same plane as their respectively adjacent primary panel 401. Specifically, in the box configuration, the link portions 414*a*, 414*b* of the at least three link portions are aligned substantially within the same plane and are substantially perpendicular to the terminal portion 415. Owing to the symmetry of the container, the additional link part 450 behaves and functions similarly (i.e., in an opposing manner) to the main link part 410 when the container is in the flat configuration and in the box configuration, and when the container is moved from the flat configuration to the box configuration. The previous description of the main link part 410 (including its coupling to the two primary panels and to one of the two secondary panels) is applicable, in an opposing manner, to the additional link part 450 (including coupling of the additional link part 450 to the two primary panels and to the other secondary panel). The main link part 410 and the additional link part 450 may be interconnected to maintain, at least partly, the container in the box configuration. Alternatively, the main link part 410 may interlock with the additional link part 450 via an interlock mechanism 460 to maintain, at least partly, the container in the box configuration.

With reference to FIGS. 1A-4P, embodiments are directed to a container 100, 200, 300, 400 movable between a flat configuration and a box configuration different from the flat configuration. The container comprises two primary panels 101, 201, 301, 401, two secondary panels 102, 202, 302, 402, and a main link part 110, 210, 310, 410 movably coupled to the two primary panels via primary-link hinges 111, 211, 311, 411. The main link part comprises at least three link portions 112, 212, 312, 412 movably coupled to each other via link-link hinges 113, 213, 313, 413. The two primary panels 101, 201, 301, 401 are configured to move away and sideways from each other when the container is moved from the flat configuration to the box configuration. The two primary panels 101, 201, 301, 401 face each other across a gap 109, 209, 309, 409 when the container is in the box configuration. The two secondary panels 102, 202, 302, 402 also face each other across the gap 109, 209, 309, 409 when the container is in the box configuration (e.g., FIGS. 1B, 1F, 2B, 2F, 3B, and 4B).

In an embodiment, each of the two primary panels 101, 201, 301, 401 is movably coupled to the two secondary panels 102, 202, 302, 402 via panel hinges 103, 203, 303, 403 (e.g., FIGS. 1B, 2B, 3B, and 4B).

In an embodiment, the two primary panels 101, 201, 301, 401 are substantially parallel to each other when the container is in the flat configuration and in the box configuration (e.g., FIGS. 1F, 1G, 2F, and 2G). It is noted that in FIGS. 1F and 1G, only portions of the primary panels 101 are shown for purposes of illustration and explanation only. Similarly, it is noted that in FIGS. 2F and 2G, only portions of the primary panels 201 are shown for purposes of illustration and explanation only.

In an embodiment, the two primary panels 101, 201, 301, 401 are substantially parallel to each other when the container is moved between the flat configuration and the box configuration (e.g., FIGS. 1C, 2C, 3C, and 4C). At least the two primary panels may be required to bend when the container is moved between the flat configuration and the box configuration.

In an embodiment, each of the primary-link hinges 111, 211, 311, 411 and the link-link hinges 113, 213, 313, 413 (and any other hinge mentioned throughout this description including, for example, panel hinges 103, 203, 303, 403) comprises an item selected from the group consisting of a perforation, a crease, a score, a bend, a section with less thickness than surrounding material, a section with less density than surrounding material, and a combination thereof.

In an embodiment, the container 100, 200, 300, 400 lies substantially in a single plane when the container is in the flat configuration (e.g., FIGS. 1D, 1G, 2D, 2G, 3D, and 4D).

In an embodiment, the container 100, 200, 300, 400 is assembled from a single sheet of material (e.g., FIGS. 1A, 2A, 3A and 4F).

In an embodiment, the container 400 is assembled from a plurality of sheets of material (e.g., FIGS. 4F, 4G, and 4H). An interlock mechanism 460 may optionally be an add-on coupled (e.g., attached) to the container 400.

In an embodiment, the container 100, 200, 300, 400 is biased towards the flat configuration, towards the box configuration, or towards both the flat configuration and the box configuration. Biasing towards the box configuration may be provided by the elastic energy generated by bending portions of the container when the container is moved from the flat configuration to the box configuration. On the other hand, biasing towards the flat configuration may be provided by the elastic energy generated by bending portions of the container when the container is moved from the box configuration to the flat configuration.

Main Link Part

In an embodiment, the main link part 110, 210, 310, 410 is folded onto the two primary panels 101, 201, 301, 401 via the primary-link hinges 111, 211, 311, 411 when the container is in the flat configuration (e.g., FIGS. 1G, 2G, 3C, and 4C).

In an embodiment, the at least three link portions 112, 212, 312, 412 are folded onto each other via at least one of the link-link hinges 113, 213, 313, 413 when the container is in the flat configuration (e.g., FIGS. 1G, 2G, 3C, and 4C).

In an embodiment, at least one 114*a*, 114*b*, 214, 314*a*, 314*b*, 414*a*, 414*b* of the at least three link portions forms, at least partly, a base panel of the container when the container is in the box configuration (e.g., FIGS. 1B, 2B, 3B, and 4B).

In an embodiment, a terminal portion 115, 215*a*, 215*b*, 315*a*, 415 of the at least three link portions and an adjacent primary panel 101, 201, 301, 401 lie substantially in a single plane when the container is in the box configuration (e.g., FIGS. 1B, 2B, 3B, and 4B).

In an embodiment, the terminal portion 415 of the at least three link portions overlaps the adjacent primary panel 401 when the container is in the box configuration (e.g., FIG. 4B).

In an embodiment, the main link part 310, 410 is movably coupled to one of the two secondary panels 302, 402 via a secondary-link hinge 316, 416 (e.g., FIGS. 3A and 4A).

In an embodiment, the main link part 310, 410 is folded onto one of the two secondary panels 302, 402 via the secondary-link hinge 316, 416 when the container is in the flat configuration (e.g., FIGS. 3A and 4A).

In an embodiment, the main link part 310 is movably coupled to the two secondary panels 302 via secondary-link hinges 316 (e.g., FIG. 3A).

In an embodiment, the main link part 110, 210, 310, 410 lies above a lowest edge of the two primary panels 106, 206, 306, 406 when the container is in the flat configuration (e.g., FIGS. 1D, 2D, 3D, and 4D).

Top Flap

In an embodiment, the container 100, 200, 300, 400 further comprises at least one primary top flap 121, 221, 321, 421 movably coupled to at least one of the two primary panels 101, 201, 301, 401 via at least one primary-top hinge 123, 223, 323, 423 (e.g., FIGS. 1A, 2A, 3A, and 4A).

In an embodiment, the container 100, 200, 300, 400 further comprises at least one secondary top flap 122, 222, 322, 422 movably coupled to at least one of the two secondary panels 102, 202, 302, 402 via at least one secondary-top hinge 124, 224, 324, 424 (e.g., FIGS. 1A, 2A, 3A, and 4A).

Bottom Flap

In an embodiment, the container 300 further comprises a primary bottom flap 331 movably coupled to a first of the two primary panels 301 via a primary-bottom hinge 333 (e.g., FIG. 3A).

In an embodiment, the primary bottom flap 331 is placed against the main link part 310 when the container is in the box configuration (e.g., FIG. 3B).

In an embodiment, the primary bottom flap 331 is adjacent to a terminal portion 315*b* of the at least three link portions when the container is in the box configuration, and thereby capable of at least partly maintaining the container in the box configuration (e.g., FIG. 3B).

In an embodiment, the primary bottom flap 331 is adjacent to one of the two secondary panels 302 when the container is in the box configuration, and thereby capable of at least partly maintaining the container in the box configuration (e.g., FIG. 3B).

In an embodiment, the primary bottom flap 331 is adjacent to a second of the two primary panels 301 when the container is in the box configuration, and thereby capable of at least partly maintaining the container in the box configuration (e.g., FIG. 3B).

In an embodiment, the primary bottom flap 331 may interlock with the main link part 310 when the container is in the box configuration. For example, the interlock may be enabled by a slit in the main link part 310 where a portion of the primary bottom flap 331 may be inserted. Alternatively, the interlock may be enabled by a friction-fit of the primary bottom flap 331 against the opposing primary panel of the two primary panels 301 and/or against the terminal portion 315*b*.

In an embodiment, the container 100, 200 further comprises at least one secondary bottom flap 132, 232 movably coupled to at least one of the two secondary panels 102, 202 via at least one secondary-bottom hinge 134, 234 (e.g., FIGS. 1A and 2A).

In an embodiment, the at least one secondary bottom flap 132, 232 is placed against the main link part 110, 210 when the container is in the box configuration (e.g., FIGS. 1B and 2B).

In an embodiment, the at least one secondary bottom flap 132, 232 is adjacent to the two primary panels 101, 201 when the container is in the box configuration, and thereby capable of at least partly maintaining the container in the box configuration (e.g., FIGS. 1B and 2B).

In an embodiment, the at least one secondary bottom flap 132, 232 may interlock with the main link part 110, 210 when the container is in the box configuration. For example, the interlock may be enabled by a slit in the main link part 110, 210 where a portion of the at least one secondary bottom flap 132, 232 may be inserted. Alternatively, the interlock may be enabled by a friction-fit of the at least one secondary bottom flap 132, 232 between the two primary panels 101, 201, between the terminal portion 115 and the opposite primary panel 101, and/or between terminal portions 215*a*, 215*b*.

Additional Link Part

In an embodiment, the container 400 further comprises an additional link part 450 movably coupled to the two primary panels 401 via additional primary-link hinges 451. The additional link part 450 comprises at least three additional link portions 452 movably coupled to each other via additional link-link hinges 453 (e.g., FIG. 4A).

In an embodiment, a first link portion 414*a* of the at least three link portions is movably coupled to a first of the two secondary panels via a secondary-link hinge 416. A second link portion 414*b* of the at least three link portions is movably coupled to a first of the two primary panels 401 via one of the primary-link hinges 411. A first additional link portion 454*a* of the at least three additional link portions is movably coupled to a second of the two secondary panels 402 via an additional secondary-link hinge 456. A second additional link portion 454*b* of the at least three additional link portions is movably coupled to a second of the two primary panels 401 via one of the additional primary-link hinges 451. The first link portion 414*a* of the at least three link portions is placed against the second additional link portion 454*b* of the at least three additional link portions when the container is in the box configuration (e.g., FIGS. 4A and 4B).

In an embodiment, a first link portion 414*a* of the at least three link portions is movably coupled to a first of the two secondary panels via a secondary-link hinge 416. A second link portion 414*b* of the at least three link portions is movably coupled to a first of the two primary panels 401 via one of the primary-link hinges 411. A first additional link portion 454*a* of the at least three additional link portions is movably coupled to a second of the two secondary panels 402 via an additional secondary-link hinge 456. A second additional link portion 454*b* of the at least three additional link portions is movably coupled to a second of the two primary panels 401 via one of the additional primary-link hinges 451. The second link portion 414*b* of the at least three link portions is placed against at least one of the first additional link portion 454*a* of the at least three additional link portions or the second additional link portion 454*b* of the at least three additional link portions, when the container is in the box configuration (e.g., FIGS. 4A and 4B).

In an embodiment, the main link part 410 interlocks with the additional link part 450 via an interlock mechanism 460 when the container is in the box configuration (e.g., FIGS. 4A, 4B, 4F, 4G, and 4H).

Exemplary Methods

Figure 5:
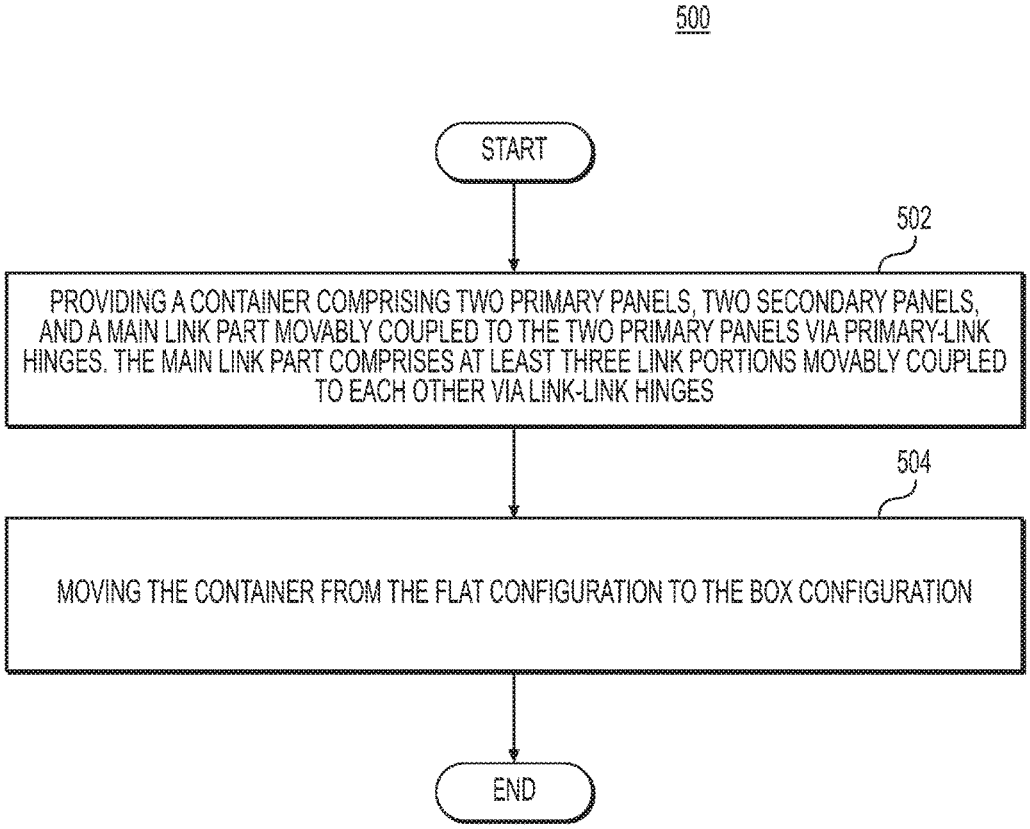
FIG. 5 is a flowchart illustrating an embodiment of a method of using a container.

Embodiments are also directed to a method of using a container that is movable between a flat configuration and a box configuration different from the flat configuration. FIG. 5 is a flowchart illustrating an embodiment of a method 500 of using a container. The method 500 comprises providing a container comprising two primary panels, two secondary panels, and a main link part movably coupled to the two primary panels via primary-link hinges, wherein the main link part comprises at least three link portions movably coupled to each other via link-link hinges (block 502). The method also comprises moving the container from the flat configuration to the box configuration (block 504), wherein the two primary panels move away and sideways from each other. The two primary panels face each other across a gap, and the two secondary panels face each other across the gap, when the container is in the box configuration.

In an embodiment, each of the two primary panels is movably coupled to the two secondary panels via panel hinges.

In an embodiment, the step of moving comprises applying pressure (i.e., inward or outward pressure) to at least one of the panel hinges.

In an embodiment, the step of providing further comprises assembling the container from a single sheet of material.

In an embodiment, the main link part is folded onto the two primary panels via the primary-link hinges when the container is in the flat configuration.

In an embodiment, the at least three link portions are folded onto each other via at least one of the link-link hinges when the container is in the flat configuration.

In an embodiment, a base panel of the container is formed, at least partly, using at least one of the at least three link portions when the container is in the box configuration.

In an embodiment, the main link part is movably coupled to one of the two secondary panels via a secondary-link hinge. The main link part is folded onto one of the two secondary panels via the secondary-link hinge when the container is in the flat configuration.

In an embodiment, the main link part is movably coupled to the two secondary panels via secondary-link hinges. The main link part is folded onto the two secondary panels via the secondary-link hinges when the container is in the flat configuration.

In an embodiment, the container further comprises a primary bottom flap movably coupled to one of the two primary panels via a primary-bottom hinge.

In an embodiment, the method further comprises placing the primary bottom flap against the main link part.

In an embodiment, the primary bottom flap is used to maintain, at least partly, the container in the box configuration.

In an embodiment, the method further comprises interlocking the primary bottom flap with the main link part.

In an embodiment, the container further comprises at least one secondary bottom flap movably coupled to at least one of the two secondary panels via at least one secondary-bottom hinge.

In an embodiment, the method further comprises placing the at least one secondary bottom flap against the main link part.

In an embodiment, the at least one secondary bottom flap is used to maintain, at least partly, the container in the box configuration.

In an embodiment, the method further comprises interlocking the at least one secondary bottom flap with the main link part.

In an embodiment, the container further comprises an additional link part movably coupled to the two primary panels via additional primary-link hinges, wherein the additional link part comprises at least three additional link portions movably coupled to each other via additional link-link hinges.

In an embodiment, a first link portion of the at least three link portions is movably coupled to a first of the two secondary panels via a secondary-link hinge, wherein a second link portion of the at least three link portions is movably coupled to a first of the two primary panels via one of the primary-link hinges, wherein a first additional link portion of the at least three additional link portions is movably coupled to a second of the two secondary panels via an additional secondary-link hinge, wherein a second additional link portion of the at least three additional link portions is movably coupled to a second of the two primary panels via one of the additional primary-link hinges, and wherein the step of moving further comprises placing the first link portion of the at least three link portions against the second additional link portion of the at least three additional link portions.

In an embodiment, a first link portion of the at least three link portions is movably coupled to a first of the two secondary panels via a secondary-link hinge, wherein a second link portion of the at least three link portions is movably coupled to a first of the two primary panels via one of the primary-link hinges, wherein a first additional link portion of the at least three additional link portions is movably coupled to a second of the two secondary panels via an additional secondary-link hinge, wherein a second additional link portion of the at least three additional link portions is movably coupled to a second of the two primary panels via one of the additional primary-link hinges, and wherein the step of moving further comprises placing the second link portion of the at least three link portions against at least one of the first additional link portion of the at least three additional link portions or the second additional link portion of the at least three additional link portions.

In an embodiment, the step of moving further comprises interlocking the main link part with the additional link part via an interlock mechanism.

In an embodiment, the method further comprises moving the container from the box configuration to the flat configuration, wherein the two primary panels are moved towards each other.

Additional Description

Although embodiments are described above with reference to a container, wherein the two primary panels are moved clockwise as the container transitions from the flat configuration to the box configuration, the two primary panels described in any of the above embodiments may alternatively move counter-clockwise as the container transitions from the flat configuration to the box configuration. This may be achieved by changing the orientation of the primary-link hinges and of the link-link hinges, and/or providing a reverse configuration of any other portion (or all portions) of the container as compared to those described in any of the above embodiments. Such alternatives are considered to be within the spirit and scope of the present invention, and may therefore utilize the advantages of the configurations and embodiments described above.

In addition, although embodiments are described above with reference to a container, wherein the two primary panels and the two secondary panels are positioned as the side panels of the container when the container is in the box configuration, the two primary panels (or alternatively the two secondary panels) described in any of the above embodiments may alternatively be positioned as the top and bottom panels of the container (e.g., if the container is rotated sideways), whereby an opening to the interior of the container is on a side of the container when the container is in the box configuration. Such alternatives are considered to be within the spirit and scope of the present invention, and may therefore utilize the advantages of the configurations and embodiments described above.

Further, although embodiments are described above with reference to a container, wherein the main link part forms, at least partly, a base panel that is positioned at the bottom of the container when the container is in the box configuration, the main link part described in any of the above embodiments may alternatively form a base panel having a different positioning (e.g., the main link part may form a top base panel if the container is flipped upside down) or the base panel may be suspended at a position between a bottom and top of the container (e.g., if the main link part forms a base panel that is positioned above a lowest edge of the two primary panels when the container is in the box configuration). Such alternatives are considered to be within the spirit and scope of the present invention, and may therefore utilize the advantages of the configurations and embodiments described above.

Yet further, although embodiments are described above with reference to a container, wherein the distance between the two primary panels is smaller than the distance between the two secondary panels when the container is in the box configuration, the distance between the two primary panels described in any of the above embodiments may alternatively be larger than or equal to the distance between the two secondary panels when the container is in the box configuration. The main link part may connect the two facing panels with the shorter distance between each other, or alternatively may connect the two facing panels with the greater distance between each other. Such alternatives are considered to be within the spirit and scope of the present invention, and may therefore utilize the advantages of the configurations and embodiments described above.

Yet further, although embodiments are described above with reference to a container, wherein the two primary panels and the two secondary panels have equal height, the two primary panels and the two secondary panels described in any of the above embodiments may alternatively have different heights (e.g., the two secondary panels may be shorter than the two primary panels). In another alternative, the height of one primary panel may be different than the other. In yet another alternative, the height of one secondary panel may be different than the other). Such alternatives are considered to be within the spirit and scope of the present invention, and may therefore utilize the advantages of the configurations and embodiments described above.

Yet further, although embodiments are described above with reference to a container, wherein the two primary panels are identical (e.g., with the same size, dimensions, thickness, shape, and weight) and the two secondary panels are identical (e.g., with the same size, dimensions, thickness, shape, and weight), the two primary panels described in any of the above embodiments may alternatively be non-identical (e.g., with different size, dimensions, thickness, shape, and/or weight). Similarly, the two secondary panels described in any of the above embodiments may alternatively be non-identical (e.g., with different size, dimensions, thickness, shape, and/or weight). Portions or all of the container may be configured based on the desired size, dimensions, thickness, shape, and/or weight of the two primary panels and/or of the two secondary panels. Such alternatives are considered to be within the spirit and scope of the present invention, and may therefore utilize the advantages of the configurations and embodiments described above.

Yet further, although embodiments are described and/or shown above with reference to a container, wherein the shape defined by the two primary panels and the two secondary panels is rectangular when the container is in the box configuration, the shape defined by the two primary panels and the two secondary panels described and/or shown in any of the above embodiments may alternatively have other shapes when the container is in the box configuration (e.g., trapezoid, parallelogram, hexagonal, etc.). The main link part and the various hinges (and/or other portions or all portions of the container) may be configured based on the desired shape defined by the two primary panels and the two secondary panels when the container is in the box configuration. Such alternatives are considered to be within the spirit and scope of the present invention, and may therefore utilize the advantages of the configurations and embodiments described above.

Yet further, although embodiments are described and/or shown above with reference to a container, wherein the shape defined by the two primary panels, the base panel, and the top of the container is rectangular when the container is in the box configuration, the shape defined by the two primary panels, the base panel, and the top of the container described and/or shown in any of the above embodiments may alternatively have other shapes when the container is in the box configuration (e.g., trapezoid, parallelogram, hexagonal, etc.). The main link part and the various hinges (and/or other portions or all portions of the container) may be configured based on the desired shape defined by the two primary panels, the base panel, and the top of the container when the container is in the box configuration. Such alternatives are considered to be within the spirit and scope of the present invention, and may therefore utilize the advantages of the configurations and embodiments described above.

Yet further, although embodiments are described and/or shown above with reference to a container, wherein the shape defined by the two secondary panels, the base panel, and the top of the container is rectangular when the container is in the box configuration, the shape defined by the two secondary panels, the base panel, and the top of the container described and/or shown in any of the above embodiments may alternatively have other shapes when the container is in the box configuration (e.g., trapezoid, parallelogram, hexagonal, etc.). The main link part and the various hinges (and/or other portions or all portions of the container) may be configured based on the desired shape defined by the two secondary panels, the base panel, and the top of the container when the container is in the box configuration. Such alternatives are considered to be within the spirit and scope of the present invention, and may therefore utilize the advantages of the configurations and embodiments described above.

Yet further, although embodiments are described above with reference to a container, wherein the angle between the primary-link hinges and the panel hinges is either 45° or 90°, the angle between the primary-link hinges and the panel hinges described in any of the above embodiments may alternatively have different values. The main link part and the link-link hinges (or any other portion or all portions of the container) may be configured based on the desired angle between the primary-link hinges and the panel hinges. Such alternatives are considered to be within the spirit and scope of the present invention, and may therefore utilize the advantages of the configurations and embodiments described above.

Yet further, although embodiments are described above with reference to a container, wherein the angle between the link-link hinges and the two primary panels is 0°, 45°, or 90° when the container is in the box configuration, the angle between the link-link hinges and the two primary panels described in any of the above embodiments may alternatively have different values when the container is in the box configuration. The main link part and the primary-link hinges (or any other portion or all portions of the container) may be configured based on the desired angle between the link-link hinges and the two primary panels when the container is in the box configuration. Such alternatives are considered to be within the spirit and scope of the present invention, and may therefore utilize the advantages of the configurations and embodiments described above.

Yet further, embodiments are described above with reference to a container, wherein the manufacturing and assembly processes may vary based on the dimensions, thickness, shape, composition, weight, and features of the container and portions of the container. The container in any of the above embodiments may be produced using any suitable manufacturing and assembly process, method, technique, or strategy. Such alternatives are considered to be within the spirit and scope of the present invention, and may therefore utilize the advantages of the configurations and embodiments described above.

Yet further, although embodiments are described above with reference to a container, wherein the at least one primary top flap and the at least one secondary top flap are not shown or described as folded onto the two primary panels and the two secondary panels, respectively, when the container is in the flat configuration, the at least one primary top flap and/or the at least one secondary top flap described in any of the above embodiments may alternatively be folded onto the two primary panels and onto the two secondary panels, respectively, when the container is in the flat configuration. For example, the at least one primary top flap and the at least one secondary top flap may be folded inside the container (i.e., tucked in) when the container is in the flat configuration to, for example, reduce the shipping volume of flat containers. Such alternatives are considered to be within the spirit and scope of the present invention, and may therefore utilize the advantages of the configurations and embodiments described above.

Yet further, although embodiments are described above with reference to a container, wherein the two primary panels are in contact with or substantially close to each other when the container is the flat configuration, the two primary panels described in any of the above embodiments may alternatively be not in contact with nor substantially close to each other when the container is in the flat configuration (i.e., with a measurable separation provided between the two primary panels). Such alternatives are considered to be within the spirit and scope of the present invention, and may therefore utilize the advantages of the configurations and embodiments described above.

Yet further, although embodiments are described above with reference to a container, wherein the two primary panels, two secondary panels, and the at least three link portions are planar (e.g., flat, straight, etc.), one or more of these portions of the container described in any of the above embodiments may alternatively be non-planar and may comprise, for example, one or more curved (or other shape) walls, surfaces, or portions (e.g., natural curved shapes, bending shapes under stress, surfaces rigidly connected, surfaces connected by hinges, facets, or combinations thereof). Such alternatives are considered to be within the spirit and scope of the present invention, and may therefore utilize the advantages of the configurations and embodiments described above.

Yet further, although embodiments are described above with reference to a container with uniform portions (e.g., with uniform thickness), portions or all of the container described in any of the above embodiments may alternatively be non-uniform (e.g., having varying thickness, discontinuities such as holes, slits, grooves, ridges, slits, a combination thereof, etc.). Such alternatives are considered to be within the spirit and scope of the present invention, and may therefore utilize the advantages of the configurations and embodiments described above.

Yet further, portions (including, for example, various hinges) or all of the container described in any of the above embodiments maybe non-rigid and may be required to bend when the container is moved from the flat configuration to the box configuration, and/or moved from the box configuration to the flat configuration. Such alternatives are considered to be within the spirit and scope of the present invention, and may therefore utilize the advantages of the configurations and embodiments described above.

The method steps in any of the embodiments described herein are not restricted to being performed in any particular order. Also, structures mentioned in any of the method embodiments may utilize structures mentioned in any of the device embodiments. Such structures may be described in detail with respect to the device embodiments only but are applicable to any of the method embodiments.

Features in any of the embodiments described in this disclosure may be employed in combination with features in other embodiments described herein, such combinations are considered to be within the spirit and scope of the present invention.

The contemplated modifications and variations specifically mentioned in this disclosure are considered to be within the spirit and scope of the present invention.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

The invention claimed is:

1. A container movable between a flat configuration and a box configuration different from the flat configuration, the container comprising:

two primary panels;

two secondary panels; and a main link part movably coupled to the two primary panels via primary-link hinges, wherein the main link part comprises at least three link portions movably coupled to each other via link-link hinges;

wherein the two primary panels are configured to simultaneously move away and move laterally, with respect to each other, when the container is moved from the flat configuration to the box configuration, wherein the two primary panels face each other across a gap when the container is in the box configuration, and wherein the two secondary panels face each other across the gap when the container is in the box configuration.

2. The container of claim 1, wherein each of the two primary panels is movably coupled to the two secondary panels via panel hinges.

3. The container of claim 1, wherein the two primary panels are substantially parallel to each other when the container is in the flat configuration and in the box configuration.

4. The container of claim 3, wherein the two primary panels are substantially parallel to each other when the container is moved between the flat configuration and the box configuration.

5. The container of claim 1, wherein each of the primary-link hinges and the link-link hinges comprises an item selected from the group consisting of a perforation, a crease, a score, a bend, a section with less thickness than surrounding material, a section with less density than surrounding material, and a combination thereof.

6. The container of claim 1, wherein the container lies substantially in a single plane when the container is in the flat configuration.

7. The container of claim 1, wherein the container is assembled from a single sheet of material.

8. The container of claim 1, wherein the container is biased towards the box configuration, towards the flat configuration, or towards both the flat configuration and the box configuration.

9. The container of claim 1, wherein the main link part is folded onto the two primary panels via the primary-link hinges when the container is in the flat configuration.

10. The container of claim 1, wherein the at least three link portions are folded onto each other via at least one of the link-link hinges when the container is in the flat configuration.

11. The container of claim 1, wherein at least one of the at least three link portions forms, at least partly, a base panel of the container when the container is in the box configuration.

12. The container of claim 1, wherein a terminal portion of the at least three link portions and an adjacent primary panel lie substantially in a single plane when the container is in the box configuration.

13. The container of claim 12, wherein the terminal portion of the at least three link portions overlaps the adjacent primary panel when the container is in the box configuration.

14. The container of claim 1, wherein the main link part is movably coupled to one of the two secondary panels via a secondary-link hinge.

15. The container of claim 14, wherein the main link part is folded onto one of the two secondary panels via the secondary-link hinge when the container is in the flat configuration.

16. The container of claim 1, wherein the main link part is movably coupled to the two secondary panels via secondary-link hinges.

17. The container of claim 1, wherein the main link part lies above a lowest edge of the two primary panels when the container is in the flat configuration.

18. The container of claim 1, wherein the container further comprises a primary bottom flap movably coupled to a first of the two primary panels via a primary-bottom hinge.

19. The container of claim 18, wherein the primary bottom flap is placed against the main link part when the container is in the box configuration.

20. The container of claim 18, wherein the primary bottom flap is adjacent to a terminal portion of the at least three link portions when the container is in the box configuration, and thereby capable of at least partly maintaining the container in the box configuration.

21. The container of claim 18, wherein the primary bottom flap is adjacent to one of the two secondary panels when the container is in the box configuration, and thereby capable of at least partly maintaining the container in the box configuration.

22. The container of claim 18, wherein the primary bottom flap is adjacent to a second of the two primary panels when the container is in the box configuration, and thereby capable of at least partly maintaining the container in the box configuration.

23. The container of claim 18, wherein the primary bottom flap interlocks with the main link part when the container is in the box configuration.

24. The container of claim 1, wherein the container further comprises at least one secondary bottom flap movably coupled to at least one of the two secondary panels via at least one secondary-bottom hinge.

25. The container of claim 24, wherein the at least one secondary bottom flap is placed against the main link part when the container is in the box configuration.

26. The container of claim 24, wherein the at least one secondary bottom flap is adjacent to the two primary panels when the container is in the box configuration, and thereby capable of at least partly maintaining the container in the box configuration.

27. The container of claim 24, wherein the at least one secondary bottom flap interlocks with the main link part when the container is in the box configuration.

28. The container of claim 1, wherein the container further comprises an additional link part movably coupled to the two primary panels via additional primary-link hinges, and wherein the additional link part comprises at least three additional link portions movably coupled to each other via additional link-link hinges.

29. The container of claim 28, wherein a first link portion of the at least three link portions is movably coupled to a first of the two secondary panels via a secondary-link hinge, wherein a second link portion of the at least three link portions is movably coupled to a first of the two primary panels via one of the primary-link hinges, wherein a first additional link portion of the at least three additional link portions is movably coupled to a second of the two secondary panels via an additional secondary-link hinge, wherein a second additional link portion of the at least three additional link portions is movably coupled to a second of the two primary panels via one of the additional primary-link hinges, and wherein the first link portion of the at least three link portions is placed against the second additional link portion of the at least three additional link portions when the container is in the box configuration.

30. The container of claim 28, wherein a first link portion of the at least three link portions is movably coupled to a first of the two secondary panels via a secondary-link hinge, wherein a second link portion of the at least three link portions is movably coupled to a first of the two primary panels via one of the primary-link hinges, wherein a first additional link portion of the at least three additional link portions is movably coupled to a second of the two secondary panels via an additional secondary-link hinge, wherein a second additional link portion of the at least three additional link portions is movably coupled to a second of the two primary panels via one of the additional primary-link hinges, and wherein the second link portion of the at least three link portions is placed against at least one of the first additional link portion of the at least three additional link portions or the second additional link portion of the at least three additional link portions, when the container is in the box configuration.

31. The container of claim 28, wherein the main link part interlocks with the additional link part via an interlock mechanism when the container is in the box configuration.

32. A method of using a container that is movable between a flat configuration and a box configuration different from the flat configuration, the method comprising:

providing a container comprising:

two primary panels;

two secondary panels; and a main link part movably coupled to the two primary panels via primary-link hinges, wherein the main link part comprises at least three link portions movably coupled to each other via link-link hinges; and moving the container from the flat configuration to the box configuration, wherein the two primary panels simultaneously move away and move laterally, with respect to each other;

wherein the two primary panels face each other across a gap when the container is in the box configuration, and wherein the two secondary panels face each other across the gap when the container is in the box configuration.

33. The method of claim 32, wherein each of the two primary panels is movably coupled to the two secondary panels via panel hinges.

34. The method of claim 33, wherein the step of moving comprises applying pressure to at least one of the panel hinges.

35. The method of claim 32, wherein the step of providing further comprises assembling the container from a single sheet of material.

36. The method of claim 32, wherein the main link part is folded onto the two primary panels via the primary-link hinges when the container is in the flat configuration.

37. The method of claim 32, wherein the at least three link portions are folded onto each other via at least one of the link-link hinges when the container is in the flat configuration.

38. The method of claim 32, wherein a base panel of the container is formed, at least partly, using at least one of the at least three link portions when the container is in the box configuration.

39. The method of claim 32, wherein the main link part is movably coupled to one of the two secondary panels via a secondary-link hinge, and wherein the main link part is folded onto one of the two secondary panels via the secondary-link hinge when the container is in the flat configuration.

40. The method of claim 32, wherein the main link part is movably coupled to the two secondary panels via secondary-link hinges, and wherein the main link part is folded onto the two secondary panels via the secondary-link hinges when the container is in the flat configuration.

41. The method of claim 32, wherein the container further comprises a primary bottom flap movably coupled to one of the two primary panels via a primary-bottom hinge.

42. The method of claim 41, further comprising placing the primary bottom flap against the main link part.

43. The method of claim 41, further comprising interlocking the primary bottom flap with the main link part.

44. The method of claim 32, wherein the container further comprises at least one secondary bottom flap movably coupled to at least one of the two secondary panels via at least one secondary-bottom hinge.

45. The method of claim 44, further comprising placing the at least one secondary bottom flap against the main link part.

46. The method of claim 44, further comprising interlocking the at least one secondary bottom flap with the main link part.

47. The method of claim 32, wherein the container further comprises an additional link part movably coupled to the two primary panels via additional primary-link hinges, and wherein the additional link part comprises at least three additional link portions movably coupled to each other via additional link-link hinges.

48. The method of claim 47, wherein a first link portion of the at least three link portions is movably coupled to a first of the two secondary panels via a secondary-link hinge, wherein a second link portion of the at least three link portions is movably coupled to a first of the two primary panels via one of the primary-link hinges, wherein a first additional link portion of the at least three additional link portions is movably coupled to a second of the two secondary panels via an additional secondary-link hinge, wherein a second additional link portion of the at least three additional link portions is movably coupled to a second of the two primary panels via one of the additional primary-link hinges, and wherein the step of moving further comprises placing the first link portion of the at least three link portions against the second additional link portion of the at least three additional link portions.

49. The method of claim 47, wherein a first link portion of the at least three link portions is movably coupled to a first of the two secondary panels via a secondary-link hinge, wherein a second link portion of the at least three link portions is movably coupled to a first of the two primary panels via one of the primary-link hinges, wherein a first additional link portion of the at least three additional link portions is movably coupled to a second of the two secondary panels via an additional secondary-link hinge, wherein a second additional link portion of the at least three additional link portions is movably coupled to a second of the two primary panels via one of the additional primary-link hinges, and wherein the step of moving further comprises placing the second link portion of the at least three link portions against at least one of the first additional link portion of the at least three additional link portions or the second additional link portion of the at least three additional link portions.

50. The method of claim 47, wherein the step of moving further comprises interlocking the main link part with the additional link part via an interlock mechanism.

51. The method of claim 32, further comprising moving the container from the box configuration to the flat configuration, wherein the two primary panels are moved towards each other.

* * * * *